US005992966A

United States Patent [19]

Nitta et al.

[11] Patent Number: 5,992,966

[45] Date of Patent: Nov. 30, 1999

[54] INK JET RECORDING APPARATUS

[75] Inventors: Tetsuhiro Nitta, Yokohama; Yasutsugu Saijo, Tokyo, both of Japan

[73] Assignee: Canon Kabushiki Kaisha, Tokyo, Japan

[21] Appl. No.: 08/976,234

[22] Filed: Nov. 21, 1997

[30] Foreign Application Priority Data

Nov. 22, 1996 [JP] Japan ..... 8-327524
Nov. 26, 1996 [JP] Japan ..... 8-330269

[51] Int. Cl.[6] ..... B41J 2/165

[52] U.S. Cl. ..... 347/29; 347/32

[58] Field of Search ..... 347/22, 24, 28, 347/29, 30, 31, 32, 33, 34, 36

[56] References Cited

U.S. PATENT DOCUMENTS

| | | | |
|---|---|---|---|
| 5,260,724 | 11/1993 | Tomii et al. | 347/32 |
| 5,517,219 | 5/1996 | Uchida | 347/24 |
| 5,563,538 | 10/1996 | Osborne | 347/32 |
| 5,699,092 | 12/1997 | Kawakami et al. | 347/30 |
| 5,701,146 | 12/1997 | Akiyama et al. | 347/26 |

FOREIGN PATENT DOCUMENTS

| | | |
|---|---|---|
| 0 585 888 | 3/1994 | European Pat. Off. . |
| 0 726 153 | 8/1996 | European Pat. Off. . |
| 53-24486 | 3/1978 | Japan . |
| 54-43733 | 4/1979 | Japan . |
| 55-150396 | 11/1980 | Japan . |
| 58-128862 | 8/1983 | Japan . |
| 63-4000 | 1/1988 | Japan . |
| 1125239 | 5/1989 | Japan . |
| 5-201029 | 8/1993 | Japan . |
| 6-8460 | 1/1994 | Japan . |
| 8-281968 | 10/1996 | Japan . |
| 8-281972 | 10/1996 | Japan . |
| 2 284 576 | 6/1995 | United Kingdom . |

*Primary Examiner*—Sandra Brase
*Attorney, Agent, or Firm*—Fitzpatrick, Cella, Harper & Scinto

[57] ABSTRACT

An ink jet recording apparatus comprises an ink cap for capping an ink discharge port to discharge ink containing coloring material, a processing liquid cap for capping a processing liquid discharge port to discharge processing liquid for processing ink and preventing means for preventing the ink cap from capping the processing liquid discharge port or preventing means for preventing the processing liquid cap from capping the ink discharge port. With the structure thus arranged, it is made possible to avoid any insolubilization of coloring material contained in ink against solvent, thus maintaining the performance of such ink jet recording apparatus in good condition at all times for the excellent formation of images to be recorded.

24 Claims, 24 Drawing Sheets

INK JET RECORDING APPARATUS

BACKGROUND OF THE INVENTION

1. Field of the Invention

The present invention relates to an ink jet recording apparatus that records by discharging ink from discharging means to a recording medium.

2. Related Background Art

A recording apparatus having the functions as a printer, a copying machine, a facsimile equipment, or the like or a recording apparatus used as an output equipment for a complex electronic equipment or a work station including a computer, a word processor, or the like, is structured to record images (including characters, symbols, and the like) on a recording medium (recording material) such as a paper sheet, a thin plastic plate in accordance with recording information. The recording apparatuses are classified into those of ink jet type, wire dot type, thermal type, and laser beam type, among some others, depending on the recording method adopted by each of them, respectively.

For a recording apparatus of serial type that records while scanning in the direction intersecting the feeding direction (sub-scanning direction) of a recording medium, recording is performed on a recording medium entirely after the recording medium is set at a specific recording position by combining the recording operation by recording means (discharge means) that travels along the recording medium, and the feeding operation that feeds the recording medium in the direction intersecting the traveling direction of the recording means.

On the other hand, a recording apparatus of line type that records only in the sub-scanning direction in which a recording medium is being carried, images are recorded on a recording medium entirely after the recording medium is set at a specific position by feeding it by a given amount (pitch feeding) while the recording is performed continuously for a one-line portion altogether.

Of the recording apparatuses described above, the recording apparatus of ink jet type (ink jet recording apparatus) records by discharging ink from recording means (recording head) to a recording medium, which makes it easier to produce recording means (discharging means) compactly, and to record highly precise images at high speeds on an ordinary paper sheet without any particular treatment given to it. Therefore, this type can-operate at lower running costs. Also, being of a non-impact type, the ink jet recording apparatus has a lesser amount of noises, while making it easier to record color images using ink of multiple colors, among some other advantages. Particularly, the line type apparatus, which uses recording means of the fully multiple type that has many discharge ports arranged in the width direction of a recording sheet, makes it possible to record at higher speeds.

Particularly, the recording means (recording head) of the ink jet type that discharges ink by the utilization of thermal energy can be manufactured easily with the a highly densified arrangement of liquid flow paths (discharge port arrangement) by forming electrothermal converting member, electrodes, liquid path walls, ceiling, and the like filmed on a substrate by means of etching, deposition, sputtering, and other semiconductor manufacturing processes. In this way, its manufacture can be implemented more compactly.

Also, for an ink jet recording method or apparatus that can obtain high quality images on a recording medium, there is adopted the one that discharges an image quality enhancement agent (processing liquid) that insolubilizes or coagulates coloring material in recording ink, in addition to discharging recording ink (ordinary ink). Also, there are many demands on the materials of recording media (recording materials). In recent years, developments have been made to meet these demands so that the recording apparatuses can use cloth, leather, nonwoven textile, or even metallic material as a recording medium, besides paper (including thin paper sheet, processed paper sheet) and thin resin plate (OHP or the like). As specific apparatuses usable therefor, there is the aforesaid printer, copying machine, facsimile equipment, or the like or the recording apparatus used as the output equipment for a complex electronic equipment or work station including computer, word processor, or the like. Also, there may be cited those apparatuses and equipment that can be used for industrial production.

For the ink jet recording apparatuses described above, however, it is impossible to obtain color images having good image fastness and quality when images are formed on the recording medium which is defined as the so-called ordinary paper sheet, because the water-proofing of images thus recorded is insufficient or because it is not compatible to produce images in high density without causing feathering and running between colors when color images should be obtained.

As a method for improving the waterproof capability of images, it has been made practicable to use the ink that contains waterproof coloring material in it in recent years. However, the waterproof capability thus provided is still insufficient. Also, theoretically, this method has a drawback in that such ink is not easily soluble to water once it has been dried, and for that matter, the nozzles of a recording head tend to be clogged, and that the structure of the apparatus tends to be made more complicated in order to avoid the occurrence of such clogging.

Also, conventionally, there have been disclosed many techniques to improve the fastness of recorded images. In the specification of Japanese Patent Laid-Open Application No. 53-24486, a technique is disclosed for laking colors for fixation by giving post treatment to the colored object in order to enhance the wet fastness thereof. In the specification of Japanese Patent Laid-Open Application No. 54-43733, a recording method is disclosed in which two or more components are used to increase film formation capability when these components are in contact with each other at room temperature or at the time of being heated by use of an ink jet recording method. By the adoption of this method, it becomes possible to obtain prints that form the film that strongly adheres to the recording medium when the components are in contact with each other on it.

Also, in the specification of Japanese Patent Laid-Open Application No. 55-150396, there is disclosed a method for providing a waterproof agent for dyes of ink to form lake after images are recorded by an ink jet recording that uses water color ink. In the specification of Japanese Patent Laid-Open Application No. 58-128862, an ink jet recording method is disclosed for recording by the application of recording ink and processing ink, which are overlaid after provisionally discriminating positions of images to be recorded. The method is such that images are drawn by use of processing ink prior to the application of recording ink or processing ink is overlaid on recording ink whereby to form images beforehand or recording ink is overlaid on processing ink whereby to have drawn images beforehand, and then, processing ink is again overlaid on them to complete the image formation.

However, there are no disclosures in these documents as to recovery means for maintaining discharge reliability, the structure of recording head, the structure of ink tank, and the recording mode to improve the quality of recorded images, or the like, which is all characteristic of an ink jet recording apparatus.

Here, on the other hand, there are fundamental problems characteristic of the ink jet recording method. In other words, firstly, since recording is made by discharging ink droplets from the recording head to a recording medium such as a paper sheet, an OHP film, fine ink droplets (mist) generated aside from the main ink droplets or ink droplets rebounding from those discharged onto the recording medium are depositied to adhere to the discharge port surface of the recording head. Such adhesion of ink is concentrated around each of discharge ports in a large quantity. Then, paper particles and other foreign substances may adhere to such concentrated ink mist, thus hindering regular discharges. Therefore, ink is discharged in the unexpected directions (twisting), ink discharge is disabled (non-discharge), or some other malfunction may take place.

Secondly, when the recording head is not in recording operation or discharge ports are not allowed to discharge for a long time, to be exact, ink in the corresponding nozzles is evaporated and dried. As a result, ink becomes overly viscous and fixed, and causes nozzles to be clogged, leading to the twisting, non-discharge, and other defective discharges. To eliminate such drawback as this, an ink jet recording method should be provided with recovery means.

As means for solving the first problem, that is, means for cleaning off and removing foreign substances such as unwanted ink, paper particles adhering to the discharge port surface, which are brought about by the ink mist or rebounded ink droplets from the recording medium, a mechanism is generally adopted that clears (wipes) the discharge port surface by use of a blade formed by rubber or some other elastic material.

Also, as means for solving the second problem, it is generally practiced to adopt a mechanism given below. In other words, the discharge port surface of the recording head is covered by a cap when recording is at rest, thus preventing ink in the nozzles from being evaporated and dried so as not to allow ink from becoming overly viscous and fixed. If ink in the nozzles has become overly viscous and fixed to have caused defective discharges or if foreign substances cannot be removed by use of the blade, discharge is recovered to the normal state by exhausting the overly viscous ink in the nozzles using a suction pump connected with the aforesaid cap.

Further, for the recording operation of an on-demand type ink jet recording method, a plurality of discharge ports, which are arranged for one recording head, are not necessarily used entirely at all times. There are nozzles which are not used for a period longer than a certain time (namely, unused discharge ports). Also, for a color recording apparatus that has a plurality of recording heads, there may be some cases where all the discharge ports (nozzles) are not used, such as those provided for a recording head, but no recording data are transferred to them (a head which is not currently engaged in recording).

When the carriage travels or comes to a stop while discharge port surface is not capped, ink tends to be evaporated and dried in the discharge ports or on the surface thereof unless ink discharge is performed within a certain period of time. Then, the capability of ink discharges is lowered or the quality of recorded images is degraded after all. In order to prevent this phenomenon from taking place, it is generally practiced for an ink jet recording apparatus to discharge ink in a specific location periodically irrespective of recording data, thus exhausting ink from the nozzles and refresh ink therein for the maintenance of the normal discharge condition at all the time. Such ink discharge operation as this is called pre-discharge.

The ink discharging by means of such pre-discharge is performed toward a pre-discharged ink receptacle arranged separately in the interior of the cap of the recovery unit so that ink does not fly from the recording head unit and stains a recording medium and interior of the recording apparatus. For the suction recovery process described above, if the suction of the recording ink and processing liquid is performed by a suction pump shared by them for use, the recording ink becomes insolubilized in the suction pump, thus inviting a problem that the suction pump may be damaged.

Also, even if the suction means are separately arranged for use of recording ink and for use of processing liquid as respective systems, the processing liquid is caused to adhere to the discharge port surface of ink discharge means or enter the interior thereof when the ink suction recovery is performed. As a result, coloring material in ink is coagulated eventually with the probability that there occurs non-discharge of ink, deviation of discharging directions, or air leakage at the time of capping occurs. Meanwhile, there are various demands on the materials of recording media (recording material). In recent years, thin paper sheet and processed paper sheet (such as a paper sheet with punched holes for filing use, a scored paper sheet, an arbitrarily configured paper sheet) are in demand for use, besides paper sheet, thin plastic plate (OHP or the like) and other usual recording media.

For the serial type ink jet recording apparatus, a structure is disclosed, in which the capping operation of the recording head (discharge means) is executed by the utilization of the carriage operation in the main scanning direction, in the specifications of U.S. Pat. No. 5,563,638, Japanese Patent Laid-Open Application No. 63-4000, and others, for example. Such structure as this makes it possible to cap the recording head without any complicated mechanism to move the cap upward and downward. Also, this structure comprises only two systems arranged for driving the feeding system of recording medium and the carriage, with an advantage, among some others, that the capping operation is easily executable in the midway of recording on one sheet of recording medium.

In other words, if a capping operation should be executed by use of the feeding system of recording medium, the recording medium should be carried by an operation other than the usual stepping feed when the recording head is to be capped in the midway of recording. Therefore, such operation becomes undesirable from the viewpoint of the accuracy to be kept for feeding the recording medium. Also, when a capping operation is required, it may be possible to operate the capping without carrying the recording medium unnecessarily by partly cutting off the power transmission of the driving system for feeding the recording medium. In this case, however, backlash takes place in the essential array of feed driving of the recording medium inevitably. It becomes also undesirable to partly interrupt the system driving from the viewpoint of the accuracy that should be kept for feeding the recording medium.

Meanwhile, if the recording data are such as high resolution color information, it may take a time considerably to transfer such data from the computer to the recording apparatus per scanning operation in the main scanning direction of the carriage having discharge means (recording head) mounted on it.

Therefore, all the recording heads should be protected by capping means even in the midway of recording, because it is necessary to prevent ink from being dried or becoming overly viscous in the vicinity of discharge ports of the ink jet recording head while such data being transferred. Therefore, if only two driving systems are arranged for feeding a recording medium and driving a carriage, it becomes effective to execute the capping operation by the utilization of the carriage operation in the main scanning direction as a method needed for protecting the recording head without producing any adverse effect on the feeding accuracy of the recording medium as described earlier.

Also, it is practiced to maintain the quality of recording images in good condition by connecting a suction recovery pump with capping means in addition to the capping operation that can be executed by means of the carriage operation in the scanning direction as described above so that the ink clogging of the recording is eliminated or the overly viscous ink is removed by operating the suction pump. A suction recovery mechanism of the kind is disclosed in the specification of Japanese Patent Laid-Open Application No. 1-125239 and Japanese Patent Laid-Open Application No. 6-8460, for example.

However, the structures of the prior art described above present the drawback that it is impossible to selectively recover only a certain head by suction for an ink jet recording apparatus where a plurality of discharge means (recording heads) are arranged for color recording or the like. In other words, the conventional structure, in which the capping operation is executed for the recording heads by means of the carriage operation in the main scanning direction, is arranged to cap a plurality of recording heads altogether at a time. If a suction pump connected with any one of the caps is driven, ink is sucked from all the recording heads including those heads for which no recovery process has been required as yet. There is a disadvantage that ink is consumed wastefully. Here, therefore, various methods have been proposed in order to solve the problems that may lead to such drawback and disadvantage.

Nevertheless, for the conventional ink jet recording apparatus provided with a plurality of discharge ports (recording heads), a plurality of protection caps are used in order to prevent ink from being dried or becoming overly viscous on the circumference of discharge ports of each discharge means (recording heads), as well as to prevent adhesion of dust particles to them. Here, a part of caps dually functions as the suction cap for use of the suction recovery, and if the number of suction means is smaller than the total number of discharge means, there are still some cases where drawback may take place as described below.

In other words, if suction recovery is given to a plurality of discharge means that use ink of different colors, there may be the case where each of the caps abuts upon discharge means to be used for colors different from those used when each of them is capped for protection. As a result, the remaining ink adhering to the cap used for different color is transferred to the discharge port surface of discharge means, and then, the ink of different color on the discharge port surface is pushed into the interior of the discharge port when the wiping (wipe and clean) operation is executed after the suction recovery. To remove such ink of different color, there is a need for performing idle discharges to a certain extent so that ink of mixed colors is exhausted to the outside of the discharge ports accordingly.

In this way, although there is an advantage that the total number of caps can be curtailed by allowing them to function dually as protection caps and suction ones, not only the excessive amount of ink is consumed, but also, a disadvantage is still present that the recovery time becomes longer due to such idle discharges needed for removing ink of mixed colors.

SUMMARY OF THE INVENTION

One of the objectives of the present invention is to provide an ink jet recording apparatus capable of keeping caps and discharge means in the state that these members are apart from each other if no direct contact between them is desired at the time of suction recovery, thus preventing ink of different colors from being mixed in the discharge ports, and also, capable of preventing any pre-processing liquid that may be used for coagulating coloring material in ink from adhering to the discharge port surface or entering discharge ports of ink discharge means when the suction recovery is performed.

Another objectives of the present invention is to provide an ink jet recording apparatus capable of arranging recording ink and processing liquid not to be in contact in recording means and suction recovery unit so as to form high quality images having good waterproof capability without running at boundaries between different colors, and also, capable of preventing colors in recording ink from being insolubilized to execute image recording with higher reliability.

Still another objectives of the present invention is to provide an ink jet recording apparatus comprising an ink cap for capping an ink discharge port to discharge ink containing coloring material; a processing liquid cap for capping a processing liquid discharge port to discharge processing liquid for processing ink; and preventing means for preventing the ink cap from capping the processing liquid discharge port.

Further objectives of the present invention to provide an ink jet recording apparatus comprising an ink cap for capping an ink discharge port to discharge an ink containing a coloring material; a processing liquid cap for capping a processing liquid discharge port to discharge a processing liquid for processing the ink; and preventing means for preventing the processing liquid cap from capping the ink discharge port.

Also, the present invention is aimed at providing an ink jet recording apparatus for recording by discharging an ink from ink discharge means to a recording medium comprising a processing liquid discharge means for discharging processing liquid to the recording medium for insolubilizing dye material in recording ink against solvent, in addition to the ink discharge means; and a recovery unit for recovering the discharging capability of the ink discharge means and the processing liquid discharge means, the recovery unit being provided with capping members separately for use of the recording ink discharge means and for use of the processing liquid discharge means, a first extrusion being provided for the capping member for use of processing liquid discharge means to abut upon the recording ink discharge means for inhibiting the capping thereof, and a first recessed portion being provided for the processing liquid discharge means in a position facing the first extrusion to engage with the first extrusion.

Also, the present invention is aimed at providing an ink jet recording apparatus for recording by discharging an ink from ink discharge means to a recording medium comprising processing liquid discharge means for discharging processing liquid to the recording medium for insolubilizing dye material in a recording ink against solvent, in addition to the ink discharge means; and a recovery unit for recovering the discharging capability of the ink discharge means and the processing liquid discharge means, the recovery unit being provided with capping members separately for use of the recording ink discharge means and for use of the processing liquid discharge means, a first extrusion being provided for the processing liquid discharge means to abut upon the capping member for use of the recording ink discharge means for inhibiting the capping thereof, and a first recessed portion being provided for the capping member for use of the processing liquid discharge means in a position facing the first extrusion to engage with the first extrusion.

Also, the present invention is aimed at providing an ink jet recording apparatus for recording by discharging an ink from ink discharge means to a recording medium comprising processing liquid discharge means for discharging processing liquid to the recording medium for insolubilizing a dye material in a recording ink against solvent, in addition to the ink discharge means; and a recovery unit for recovering the discharging capability of the ink discharge means and the processing liquid discharge means, the recovery unit being provided with capping members separately for use of the recording ink discharge means and for use of the processing liquid discharge means, a first extrusion being provided for the processing liquid discharge means to abut upon the capping member for use of the recording ink discharge means for inhibiting the capping thereof, at the same time, a first recessed portion being provided for the capping member for use of the processing liquid discharge means in a position facing the first extrusion to engage with the first extrusion, and a second extrusion being provided for the capping member for use of the ink discharge means to abut upon the processing liquid discharge means for inhibiting the capping thereof, at the same time, a second recessed portion being provided for recording ink discharge means in a position facing the second extrusion to engage with the second extrusion.

Also, the present invention is aimed at providing an ink jet recording apparatus for recording by discharging an ink from ink discharge means to a recording medium comprising processing liquid discharge means for discharging a processing liquid to the recording medium for insolubilizing dye material in a recording ink against solvent, in addition to the ink discharge means; and a recovery unit for recovering the discharging capability of the ink discharge means and the processing liquid discharge means, the recovery unit being provided with capping members separately for use of the recording ink discharge means and for use of the processing liquid discharge means, a first extrusion being provided for the ink discharge means to abut upon the capping member for use of the processing liquid discharge means for inhibiting the capping thereof, at the same time, a first recessed portion being provided for the capping member for use of the ink discharge means in a position facing the first extrusion to engage with the first extrusion, and a second extrusion being provided for the capping member for use of the processing liquid discharge means to abut upon the ink discharge means for inhibiting the capping thereof, at the same time, a second recessed portion being provided for processing liquid discharge means in a position facing the second extrusion to engage with the second extrusion.

Also, the present invention is aimed at providing an ink jet recording apparatus for recording by discharging an ink from discharge means to a recording medium comprising a plurality of discharge means; a main scanning driving system for enabling the reciprocation of a carriage having discharge means mounted thereon; a plurality of caps for discharge means; and capping means for operating capping by means of a carriage movement, and a selective capping operation being made executable so as to cause some of the caps to abut upon discharge means, while the remaining caps being maintained in a state of being apart therefrom.

In this respect, it is possible to provide an ink jet recording apparatus not only capable of keeping the caps and discharge means in a state that these members are apart from each other if no direct contact between them is desired at the time of suction recovery, thus preventing ink of different colors from being mixed in the discharge ports, but also, capable of preventing the pre-processing liquid that may be used for coagulating coloring material in ink from adhering to the discharge port surface or entering the discharge ports when the suction recovery is performed.

Also, in accordance with the present invention, it is possible to arrange recording ink and processing liquid not to be in contact in recording means and recovery unit, thus providing an ink jet recording apparatus capable of forming high quality images having good waterproof capability without running at boundaries between different colors, while preventing colors in the recording ink from being insolubilized for recording images with higher reliability.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the description will be made of the embodiments in accordance with the present invention.

Figure 1:
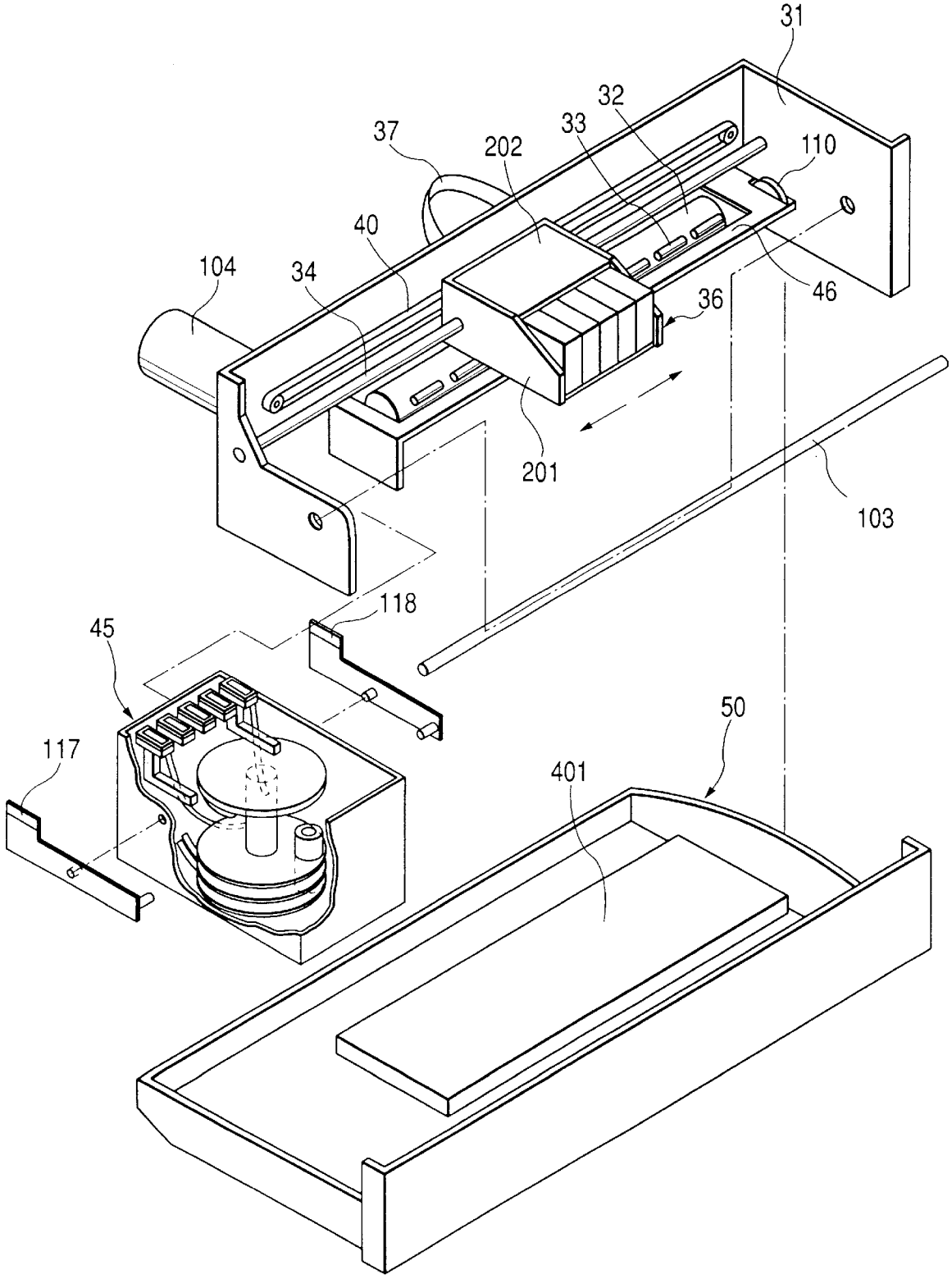
FIG. 1 is an exploded perspective view which schematically shows the entire structure of an ink jet recording apparatus to which the present invention is applicable.
Figure 2:
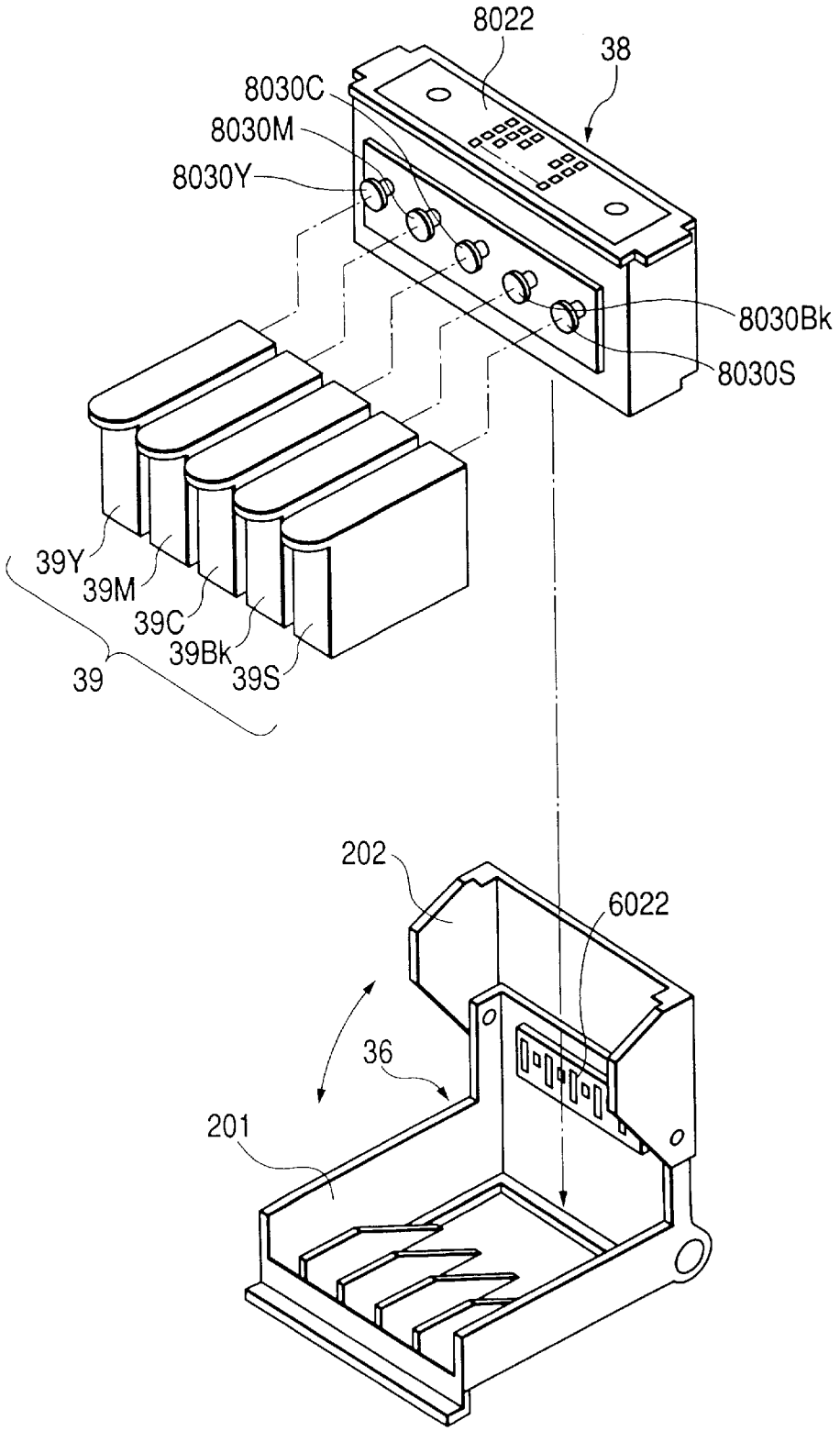
FIG. 2 is an exploded perspective view which schematically shows the carriage and ink jet means and ink tanks to be mounted on the carriage represented in FIG. 1.
Figure 3:
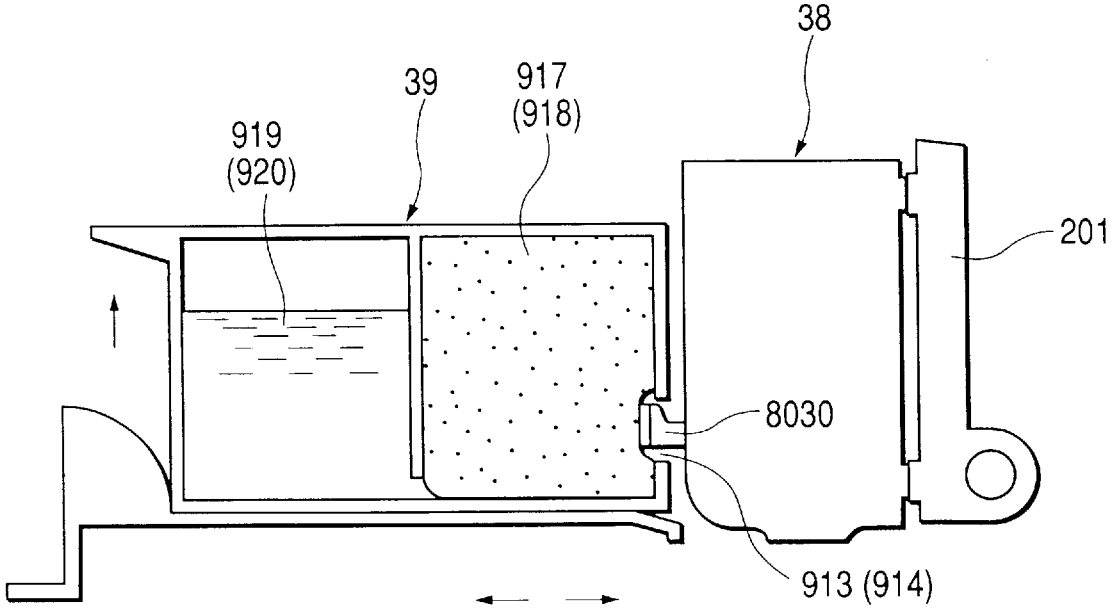
FIG. 3 is a cross-sectional view schematically showing the ink jet means and ink tank mounted on the carriage represented in FIG. 2.

FIG. 1 is an exploded perspective view which schematically shows the entire structure of an ink jet recording apparatus to which the present invention is applicable. FIG. 2 is an exploded perspective view showing the carriage and ink jet means and ink tanks to be mounted on the carriage represented in FIG. 1. FIG. 3 is a vertically sectional view schematically showing the ink jet means and ink tank mounted on the carriage represented in FIG. 2.

In FIGS. 1 to 3, a reference numeral 36 designates the carriage. On this carriage 36, recording means (ink jet means, recording head) 38 and ink tanks 39 can be mounted. The ink tanks 39 comprise a processing liquid ink tank 39S and recording ink tanks. For the present embodiment, a color recording apparatus is shown, and for the recording ink tanks, ink tanks 39B*k*, 39C, 39M, and 39Y are provided for black, cyan, magenta, and yellow, respectively. In accordance with the present embodiment, the structure is arranged so that each of the processing liquid ink tank 39S, and recording ink tanks 39B*k*, 39C, 39M, and 39Y is made individually exchangeable.

The carriage 36 comprises a carriage base 201 and head lever 202. On the carriage base 201, the recording head 28, processing liquid ink tank 39S, and each of recording ink tanks 39B*k*, 39C, 39M, and 39Y are positioned and mounted, respectively. The recording head 38 mounted on the carriage base 201 is held by means of the head lever 202.

In FIG. 2, a connector 8022 is arranged on the upper part of the recording head 38 to receive driving signals for the recording head. The connector 8022 is electrically connected with a connector 6022 arranged on the carriage 36. Also, for the recording head 38, five ink supply openings are arranged for supplying ink respectively from the processing liquid ink tank 39S, and the recording ink tanks 39B*k*, 39C, 39M, and 39Y, that is, there are arranged, from the right to the left in FIG. 2, the processing liquid ink supply opening 8030S, black ink supply opening 8030B*k*, cyan ink supply opening 8030C, magenta ink supply opening 8030M, and yellow ink supply opening 8030Y in that order. From these ink supply openings 8030, ink is supply to each of the nozzles through the flow paths in the recording head 38.

In FIG. 3, each recording ink supply opening 913 is arranged to be connected with each of the recording ink tanks 30B*k*, 39C, 39M, 39Y, and a processing liquid ink supply opening 914 is arranged to be connected with the processing liquid ink tank 39S. Also, the interior of each ink tank 39 is partitioned into two rooms. In each of the front rooms on the supply openings 913 and 914 side, absorbent 917 and 918 are provided. In each of the rooms opposite to the supply openings 913 and 914, recording ink (fresh ink) 919 and processing liquid 920 are filled. In this way, an ink tank 39, which is called semi-fresh type, is structured.

In FIG. 1, on both side walls of the U-shaped chassis 31, a guide shaft 34 and a supporting shaft 103 are fixed to slidably support the carriage 36. Driving power is given from a carriage motor 104 to the carriage 36 through a driving belt 40 so that the carriage can reciprocate slidably on these shafts 34 and 103.

Also, a recording medium (not shown) such as a recording paper sheet is pinched and carried by a carrier roller 32 and a pinch roller 33 as shown in FIG. 1. The recording medium is carried on and along a platen 46. The ink jet means (discharge means) of the recording head 38, which is mounted on the carriage 36, extrudes downward from the carriage 36. The discharge port surface of the ink jet means faces a recording medium in parallel to the platen 46 with a specific gap with the recording medium. In accordance with the present embodiment, a recovery unit (unit of recovering system) 45 is arranged on the home position side, which is on the left-hand side of the ink jet recording apparatus. Here, in FIG. 1, a reference numeral 37 designates a carriage flexible cable; 50, the main body of the recording apparatus; 110, the carrier motor (paper sheet feeding motor); and 401, a tank for retaining waste ink.

Figure 4:
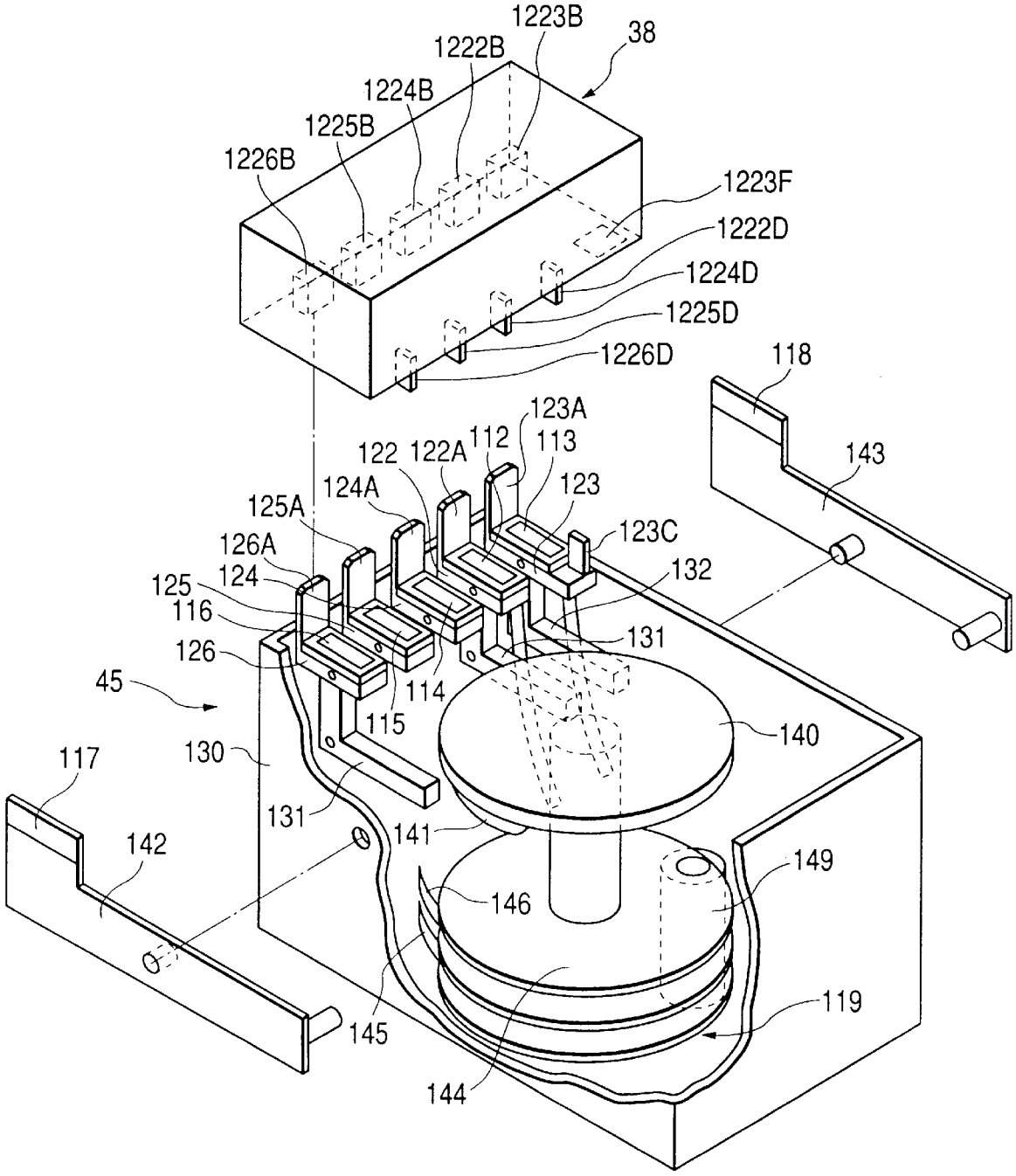
FIG. 4 is an exploded perspective view which schematically shows a recovery unit in accordance with a first embodiment of the present invention.

FIG. 4 is an exploded perspective view which shows the recovery unit 45 in accordance with the first embodiment of the present invention. The recovery unit 45 is provided with a processing liquid cap 113, Bk ink cap 112, C ink cap 114, M ink cap 115, and Y ink cap 116, from the right to the left in FIG. 4 corresponding to the processing liquid discharge means and each of color recording ink discharge means. Here, the processing liquid cap 113 and Bk cap 112 serve dually as the suction cap and the untouched cap. The C ink cap 114, M ink cap 115, and Y ink cap 116 are those dedicated only to use as untouched caps, respectively. Therefore, the suction of the Y ink discharge port, C ink opening, and M ink opening is performed by use of the Bk ink cap 112.

Figure 5:
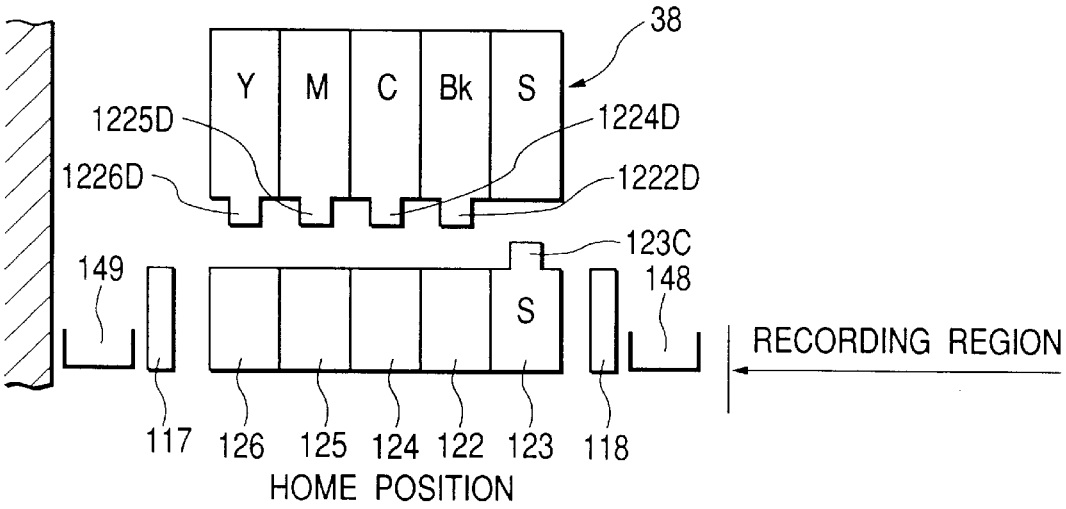
FIG. 5 is a front view which schematically shows the state where the cap is retracted in accordance with the first embodiment represented in FIG. 4.
Figure 6:
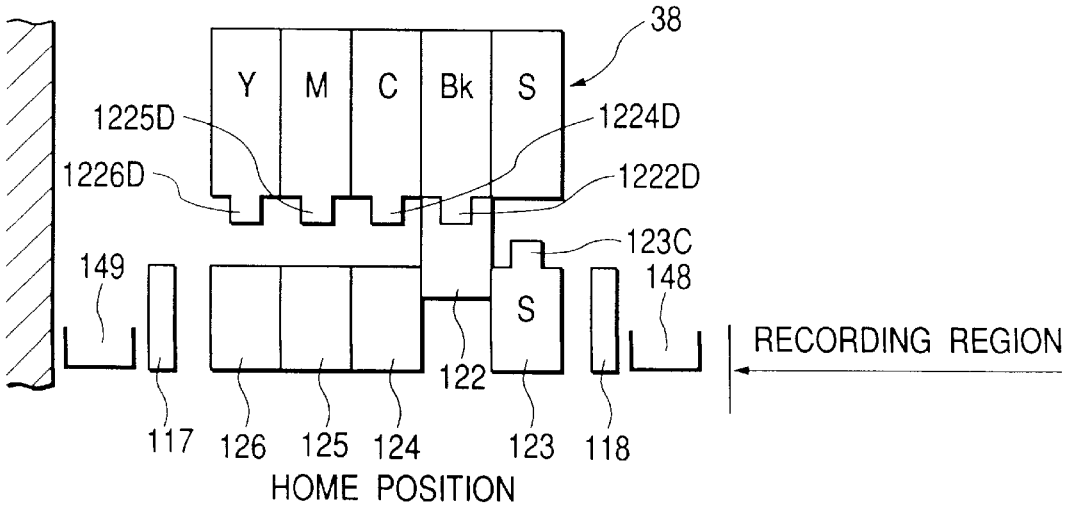
FIG. 6 is a front view which schematically shows the state where Bk ink is being sucked in accordance with the first embodiment represented in FIG. 4.
Figure 7:
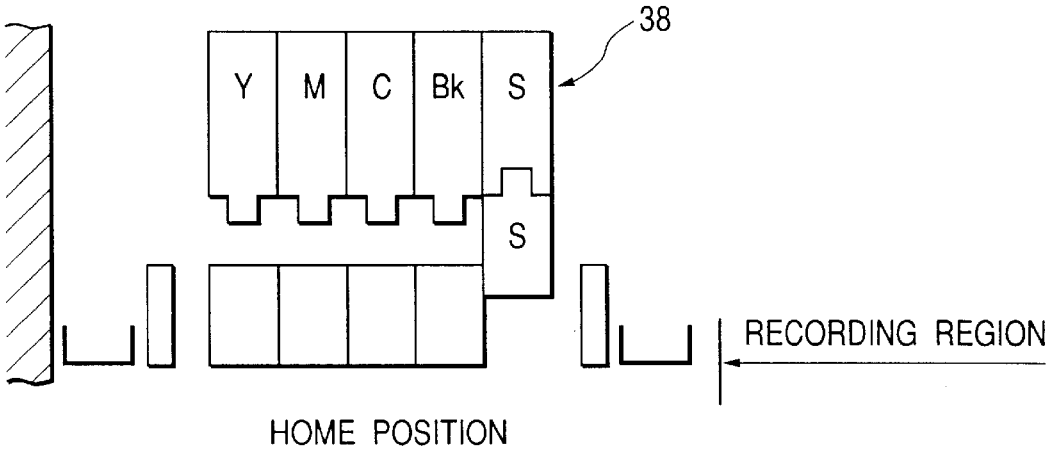
FIG. 7 is a front view which schematically shows the state where processing liquid is being sucked in accordance with the first embodiment represented in FIG. 4.
Figure 8:
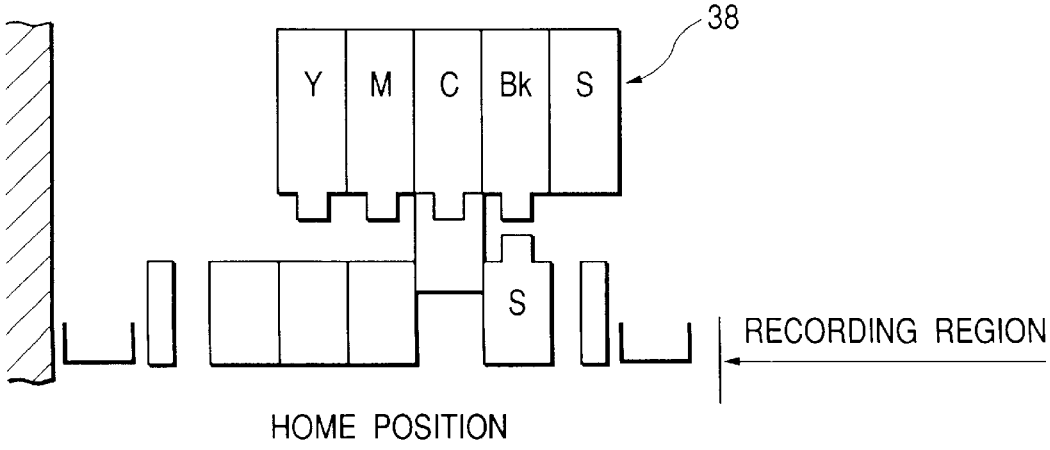
FIG. 8 is a front view which schematically shows the state where C ink is being sucked in accordance with the first embodiment represented in FIG. 4.
Figure 9:
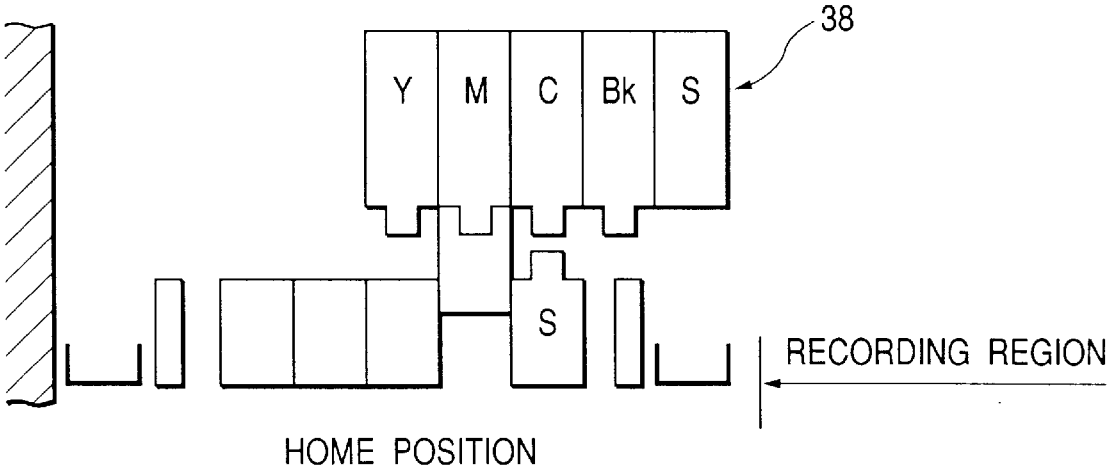
FIG. 9 is a front view which schematically shows the state where M ink is being sucked in accordance with the first embodiment represented in FIG. 4.
Figure 10:
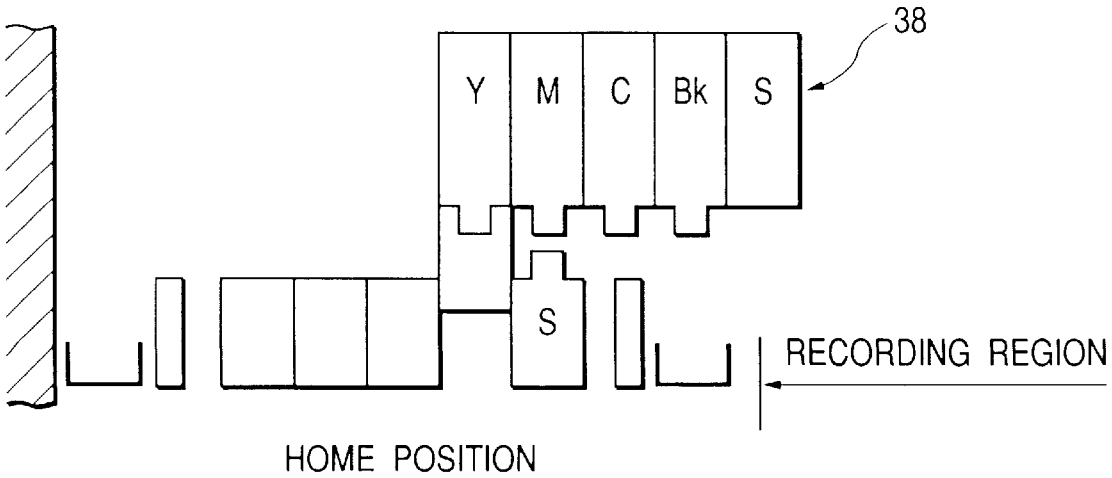
FIG. 10 is a front view which schematically shows the state where Y ink is being sucked in accordance with the first embodiment represented in FIG. 4.
Figure 11:
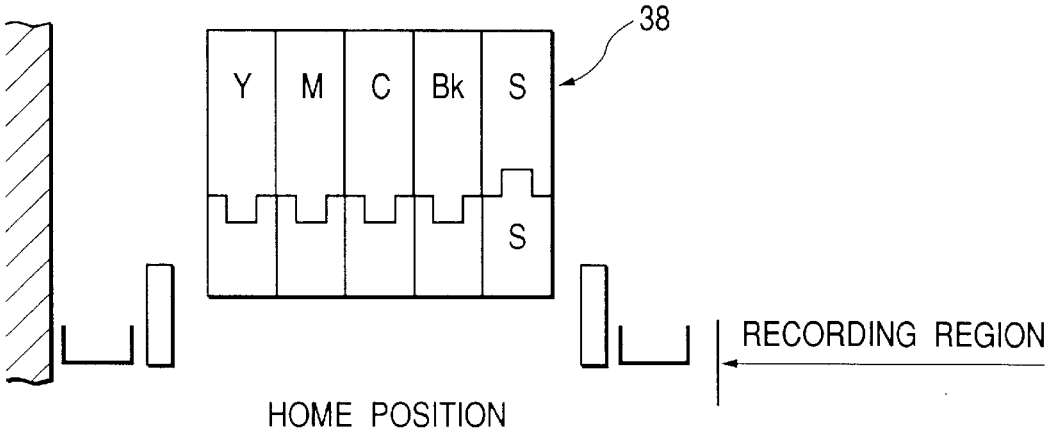
FIG. 11 is a front view which schematically shows the state where capping is left untouched in accordance with the first embodiment represented in FIG. 4.
Figure 12:
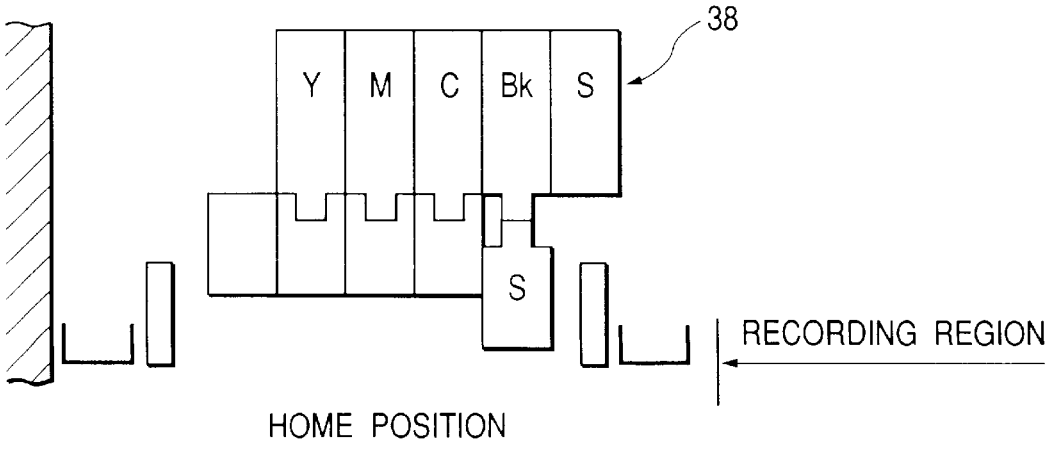
FIG. 12 is a front view which schematically shows the state of abnormal use of the recovery unit of the first embodiment represented in FIG. 4.

FIGS. 5 to 12 are views which schematically illustrate the capping operation in accordance with the first embodiment represented in FIG. 4. FIG. 5 shows the retracted state of caps. FIG. 6 shows the suction state of Bk ink. FIG. 7 shows the suction state of processing liquid. FIG. 8 shows the suction state of C ink. FIG. 9 shows the suction state of M ink. FIG. 10 shows the suction state of Y ink. FIG. 11 shows the state of untouched capping. FIG. 12 shows the state of abnormal use. Here, only one suction cap (cap 112 alone) is shown for use of recording ink (color ink). The suction of other recording ink (color ink) is shown in FIGS. 8 to 10, respectively.

In FIG. 4, the base 130 for the recovery system is provided with four cap levers 131 for use of each recording ink (each color ink), and one cap lever 132 for use of processing liquid, which are rotatively and axially supported. On the cap holders 122, 123, 124, 125, and 126, which are axially supported on the cap levers 131 and 132, the caps 112, 113, 114, 115, and 116 are axially supported. Each of the cap levers 131 and 132 are rotatively driven in the vertical direction when it is in contact with and slides on the cam surface 141 of a suction cam 140. Along this movement, each of the caps 112 to 116 is made vertically movable (to be in contact with or retracted from the recording head 38).

Here, in order to prevent recording ink (color ink) and processing liquid from being mixed and solidified in the vicinity of the discharge port surface of the recording head 38 due to capping, it is controlled so that only the processing liquid cap 113 abuts upon the recording head (processing liquid discharge port surface) when the suction recovery is executed for the processing liquid discharge means, and also, only the recording ink cap (here the Bk cap 112 alone) abuts upon the recording head (recording ink discharge port surface) when the suction recovery process is executed for recording ink (color ink) discharge means. This control is executed by controlling the rotational angles of the suction cam 140 so that each of the caps 112 to 116 is made individually movable in the vertical direction.

When the recording head 38 is positioned at its home position arranged outside the recording region, all the caps 112 to 116 are in contact with the corresponding discharge port surfaces as shown in FIG. 11. Then, by capping, it is made possible to prevent defective discharges resulting from the excessive viscosity or fixation of ink caused by the evaporation of ink.

Here, in FIG. 4, a reference numeral 117 designates a processing liquid blade that wipes off to clean (wiping) the processing liquid discharge port surface; 118, a recording ink blade that wipes off to clean (wiping) the recording ink (color ink) discharge port surface. The processing liquid blade 117 and the recording ink blade 118 are supported by the respective blade arms 142 and 143 to be vertically movable (to be in contact with and apart from the discharge port surface). Also, a reference numeral 149 in FIGS. 5 to 12 designates the receptacle for pre-discharges of recording ink (color ink), and 149, the receptacle for the pre-discharges of processing ink, respectively.

In FIGS. 4 to 12, the cap holders 122 to 126 are provided with ribs 122A to 126A. The ribs A 122A to 126A are fitted into the recessed portions B 1222B to 1226B of the recording head 38 at the time of capping so that the caps 112 to 116 are positioned to the recording head 38.

For the processing liquid cap holder 123, a rib C 123C is arranged. For the recording ink (color ink) discharge means (recording head), ribs D 1222D, 1224D, 1225D, and 1226D are arranged, respectively, in the position facing the rib C 123C at the time of capping. Usually, the rib C 123C and each of ribs D 1222D, 1224D, 1225D, and 1226D do not abut upon each other in the untouched capping state shown in FIG. 11, and also, in the respective suction states of the recording ink and processing shown in FIGS. 6 to 10.

The recording heads 38 are exchangeable without any problem in the untouched capping state as shown in FIG. 11, because each of the discharge port surfaces is positioned to face the position of each of the caps correspondingly. However, at the time of abnormal use where the position of the carriage 36 is deviated at the time of exchanging recording heads as shown in FIG. 12, for example, the recording ink (color ink) discharge means may face the processing liquid cap 113. In this case, the rib C 123C abuts upon either one of the ribs D 1222D, 1224D, 1225D, and 1226D. As a result, there is no possibility that the processing liquid cap 113 is allowed to abut upon any one of the color ink (recording ink) discharge means. In this respect, when the rib C and nd any one of the ribs D may abut upon each other, it is not necessarily to make them extrusive. In other words, if the surface F 1223F of the processing liquid discharge unit (processing liquid discharge means) of the recording head 38, which may correspond to the range of the ribs D as shown in FIG. 4, should be formed to be a recessed portion, the surface of the ribs D can be made flat, that is, it should be good enough if only the ribs D are formed to be relatively extrusive than the aforesaid surface F.

In FIGS. 4 to 12, the processing liquid cap 113 and the Bk cap 112 of the recovery unit (unit of recovering system) 45 are conductively connected with the tubes 146 and 145 of the pump unit 119 through the cap holders 123 and 122, respectively. The pump unit 119 is used for generating negative pressure to execute the suction recovery that sucks ink (color ink, processing liquid) from the respective discharge ports by causing caps to abut upon them accordingly when the recording head 38 presents any defective discharges. The pump unit 119 shown in FIG. 4 is called a tube pump.

In other words, the pump unit 119 comprises tubes 145 and 146, a roller holder 144, and a roller 147. The roller holder 144 is rotatively and axially supported on the base 130 of the recovering system. The tubes 145 and 146, which are guided by the roller holder 144, are pressed by the roller axially supported by the roller holder 144 so that the tubes 145 and 146 are being squeezed to generate negative pressure in the caps 112 and 113.

For the pump unit 119, the processing liquid tube 146 and the color ink (recording ink) tube 145 are individually arranged. The wasted liquid from these tubes is transferred to the waste liquid tank through each of the individual paths. This arrangement is needed in order to avoid insolubilization in the pump by preventing recording ink (color ink) and processing liquid from being in contact with each other in the caps and pump. Here, the pump unit 119 that has two systems, each for the processing liquid use and recording ink (color ink) use, is shown, for example, but it may be possible to provide an individual pump for each of the caps, respectively.

Figure 13:
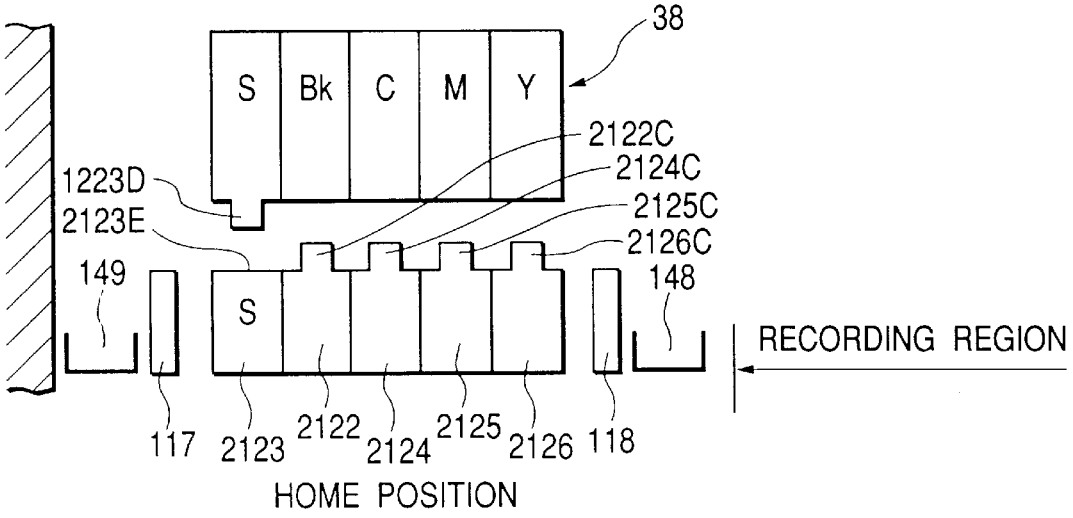
FIG. 13 is a front view which schematically shows the state where the cap of a recovery unit is retracted in accordance with a second embodiment of the present invention.
Figure 14:
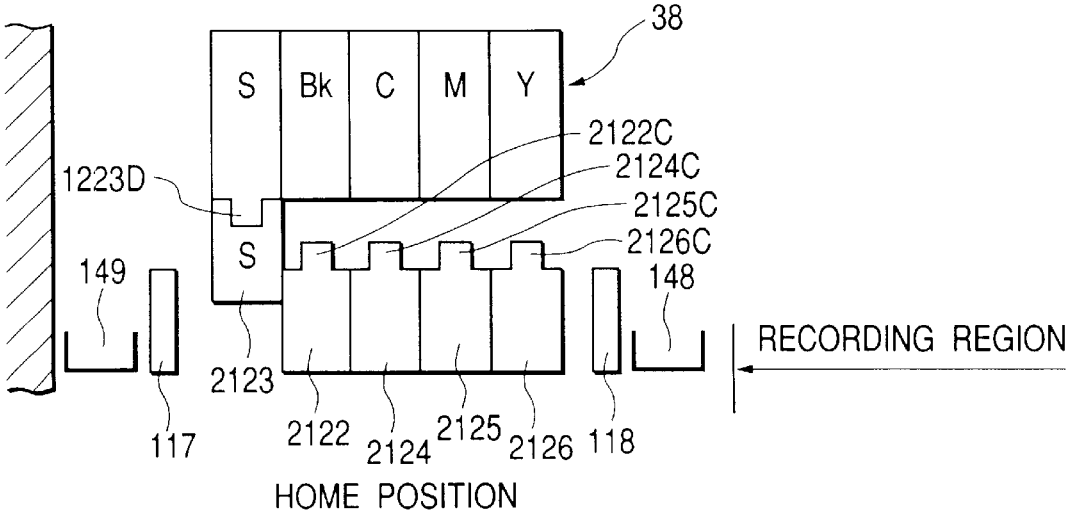
FIG. 14 is a front view which schematically shows the state where processing liquid is being sucked in accordance with the second embodiment represented in FIG. 13.
Figure 15:
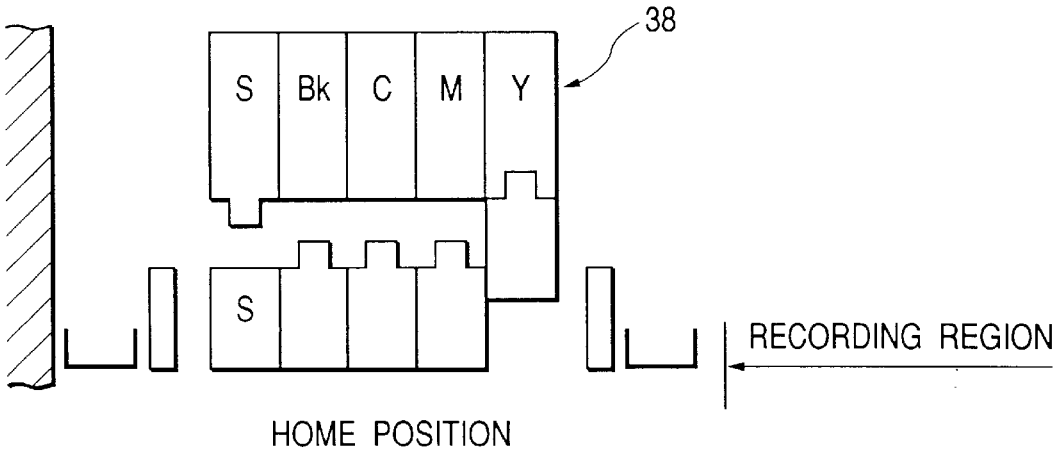
FIG. 15 is a front view which schematically shows the state where Y ink is being sucked in accordance with the second embodiment represented in FIG. 13.
Figure 16:
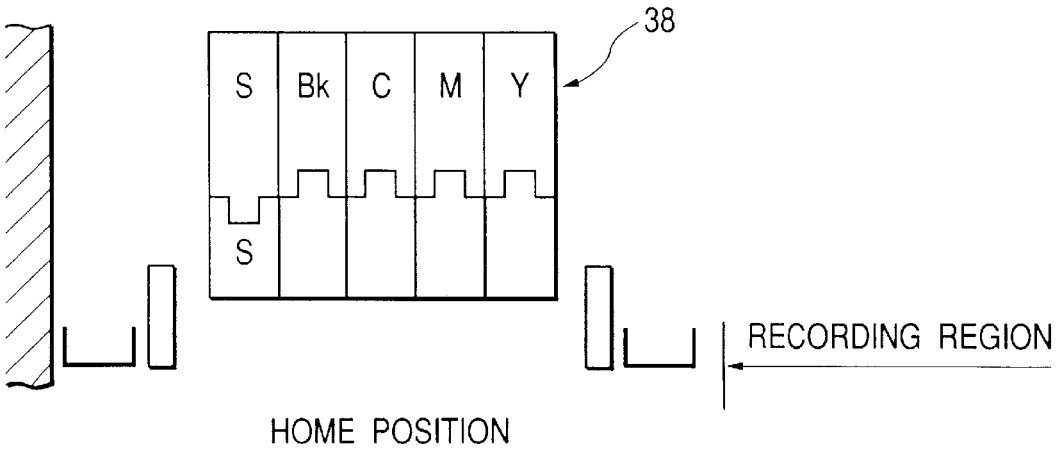
FIG. 16 is a front view which schematically shows the state where capping is left untouched in accordance with the second embodiment represented in FIG. 13.
Figure 17:
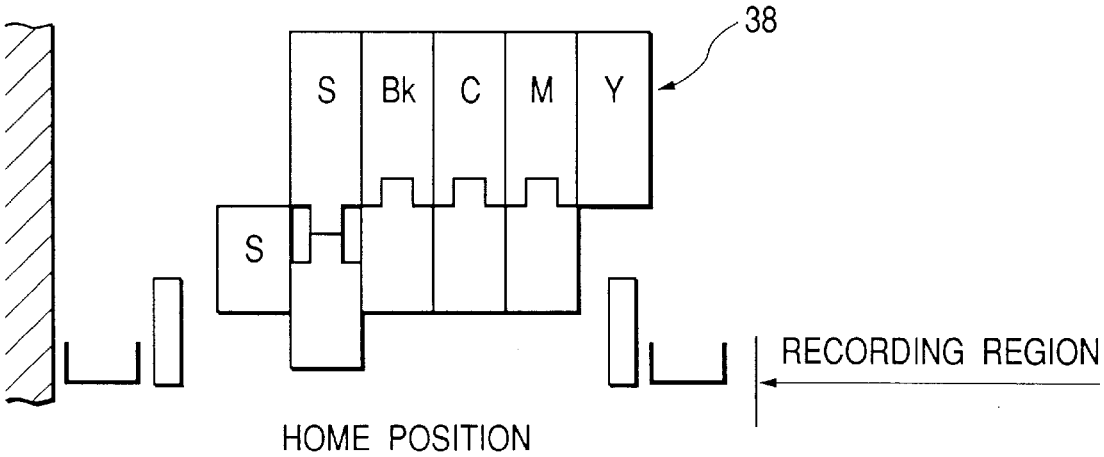
FIG. 17 is a front view which schematically shows the state of abnormal use of the recovery unit of the second embodiment represented in FIG. 13.

FIGS. 13 to 17 are views which schematically illustrate the capping operation in accordance with a second embodiment of the present invention. FIG. 13 shows the retracted state of a cap. FIG. 14 shows the state of processing liquid suction. FIG. 15 shows the state of Y ink suction. FIG. 16 shows the state of untouched capping. FIG. 17 shows the state of abnormal use. For the present embodiment, the same reference marks are applied to the same or corresponding parts as in the first embodiment. In accordance with the present embodiment, the ink supply openings 8030 of the recording head 38 are arranged from the left to the right in FIGS. 13 to 17 such as the processing liquid supply opening 8030S, the black ink supply opening 8030B*k*, the cyan ink supply opening 8030C, the magenta ink supply opening 8030M, and the yellow ink supply opening 8030Y in that order.

Here, ribs C (2122C, 2124C, 2125C, and 2126C) are provided for the recording ink (color ink) caps 112, 114, 115, and 116, respectively, and a rib D (1223D) is arranged for the processing liquid discharge means (processing liquid discharge unit) of the recording head 38 in a position that faces each of the ribs C (2122C, 2124C, 2125C, and 2126C) at the time of capping.

Therefore, as in the first embodiment, there is no possibility that the color ink (recording ink) caps are allowed to abut upon the processing liquid discharge means (processing liquid discharge port surface) even if it is intended to cap any one of them while the position of the carriage 36 is deviated, because either one of the ribs C (2122C, 2124C, 2125C, and 2126C) abuts upon the rib D as shown in FIG. 17. In this respect, when the rib C and ribs D abut upon each other, it is not necessarily to make them extrusive. In other words, if the surface E 2123E of the range of the cap holder 2123 is arranged to be a recessed portion, which may correspond to the range of the ribs C as shown in FIG. 13, the surface of each rib C of the color ink cap holders 2122, 2124, 2125, and 2126 can be made flat, that is, it should be good enough if only the ribs C are formed to be relatively extrusive than the aforesaid surface E.

Figure 18:
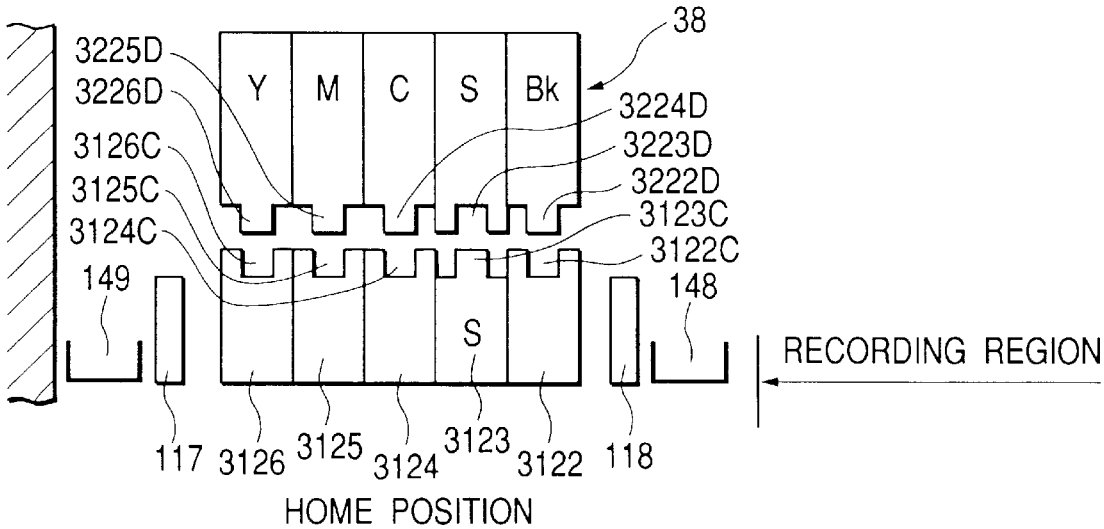
FIG. 18 is a front view which schematically shows the state where the cap of a recovery unit is retracted in accordance with a third embodiment of the present invention.
Figure 19:
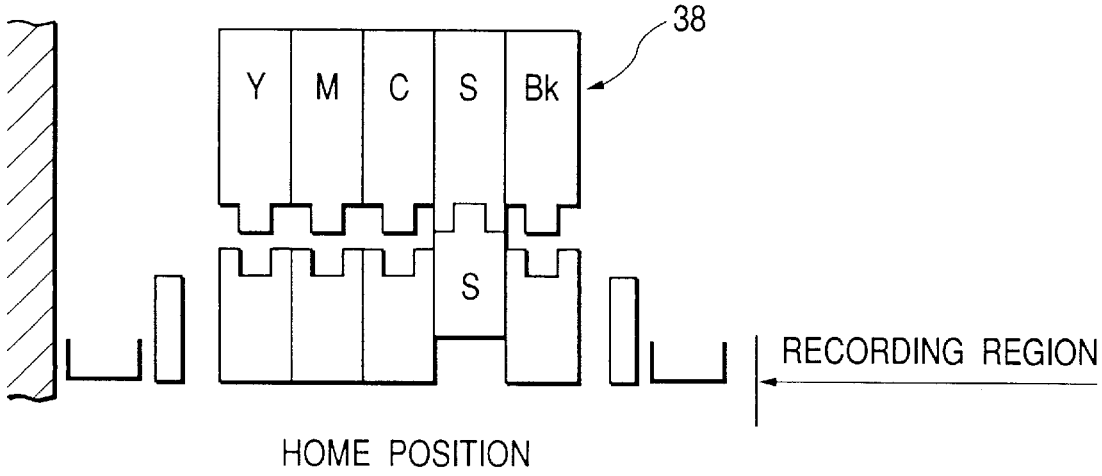
FIG. 19 is a front view which schematically shows the state where processing liquid is being sucked in accordance with the third embodiment represented in FIG. 18.
Figure 20:
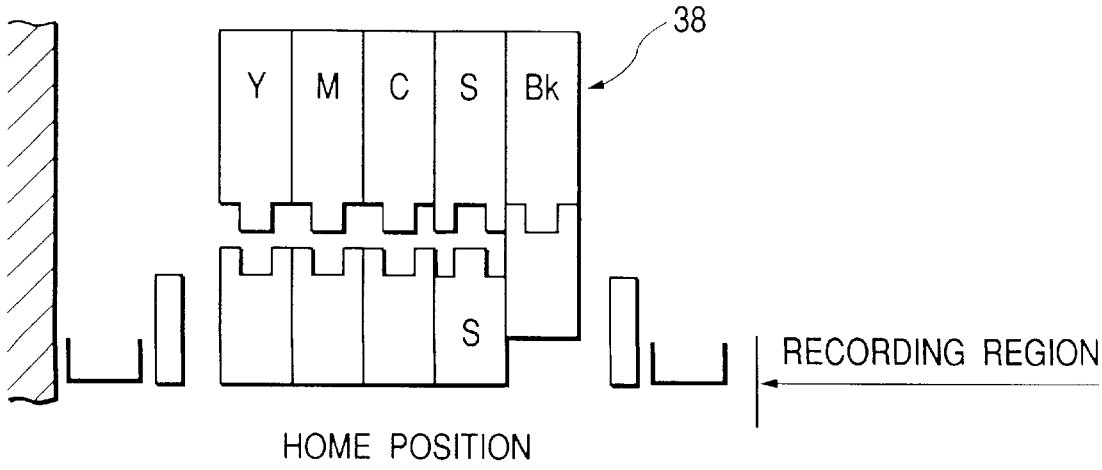
FIG. 20 is a front view which schematically shows the state where Bk ink is being sucked in accordance with the third embodiment represented in FIG. 18.
Figure 21:
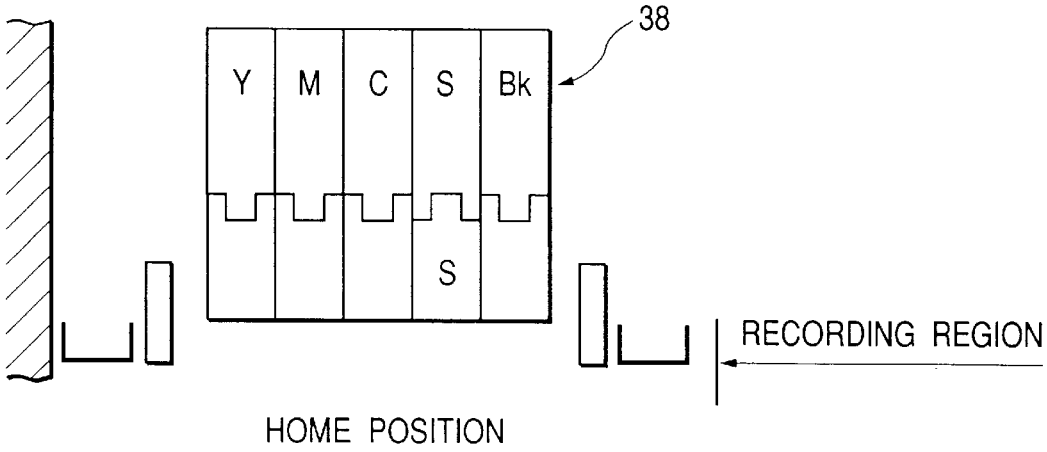
FIG. 21 is a front view which schematically shows the state where capping is left untouched in accordance with the third embodiment represented in FIG. 18.
Figure 22:
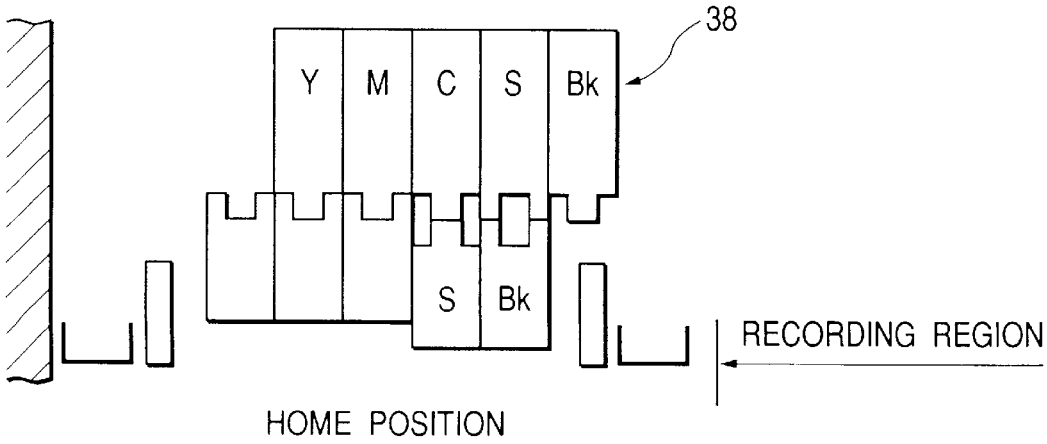
FIG. 22 is a front view which schematically shows the state of abnormal use of the recovery unit of the third embodiment represented in FIG. 18.

FIGS. 18 to 22 are views which schematically illustrate the capping operation in accordance with a third embodiment of the present invention. FIG. 18 shows the retracted state of caps. FIG. 19 shows the state of processing liquid suction. FIG. 20 shows the state of Bk ink suction. FIG. 21 shows the state of untouched capping. FIG. 22 shows the state of abnormal use. For the present embodiment, the same reference marks are applied to the same or corresponding parts as in the first and second embodiments. In accordance with the present embodiment, the ink supply openings 8030 of the recording head 38 are arranged from the right to the left in FIGS. 18 to 22 such as the black ink supply opening 8030B*k*, the processing liquid supply opening 8030S, the cyan ink supply opening 8030C, the magenta ink supply opening 8030M, and the yellow ink supply opening 8030Y in that order. In other words, the recording head is structured so that the processing supply opening is arranged between the plural color ink (recording ink) supply openings.

Here, recessed portions 3122C, 3124C, 3125C, and 3126C are provided for the cap holders 3122, 3124, 3125, and 3126 of the recording ink (color ink) caps 112, 114, 115, and 116, respectively, and an extrusion 3123C is arranged for the cap holder 3123 of the processing liquid cap 113. Also, extrusions 3222D, 3224D, 3225D, and 3226D are arranged for each of the color ink discharge means (recording head unit, ink discharge unit) of the recording head 38 in a position that faces each of the extrusions 3122C, 3124C, 3125C, and 3126C. Further, a recessed portion 322D is provided for the processing liquid discharge means (processing discharge unit) of the recording head 38 in a position that faces the extrusion 3123C of the cap holder 3123.

In accordance with the present embodiment, it is possible for the caps to be in contact with the corresponding discharge units of the recording head 38 when the extrusion and the recessed portions are allowed to face each other at the time of capping as shown in FIGS. 19 to 21. However, there is no possibility that the caps are allowed to abut upon the discharge unit (recording head unit) in a state where the recessed portions face each other or the extrusions face each other, because, in such case, the recessed portions themselves and the extrusions themselves abut upon each other. Consequently, if the position of the carriage 36 is deviated, neither processing liquid discharge unit abuts upon any one of the color ink caps nor the processing liquid cap abuts upon any one of the color ink discharge units.

Figure 23:
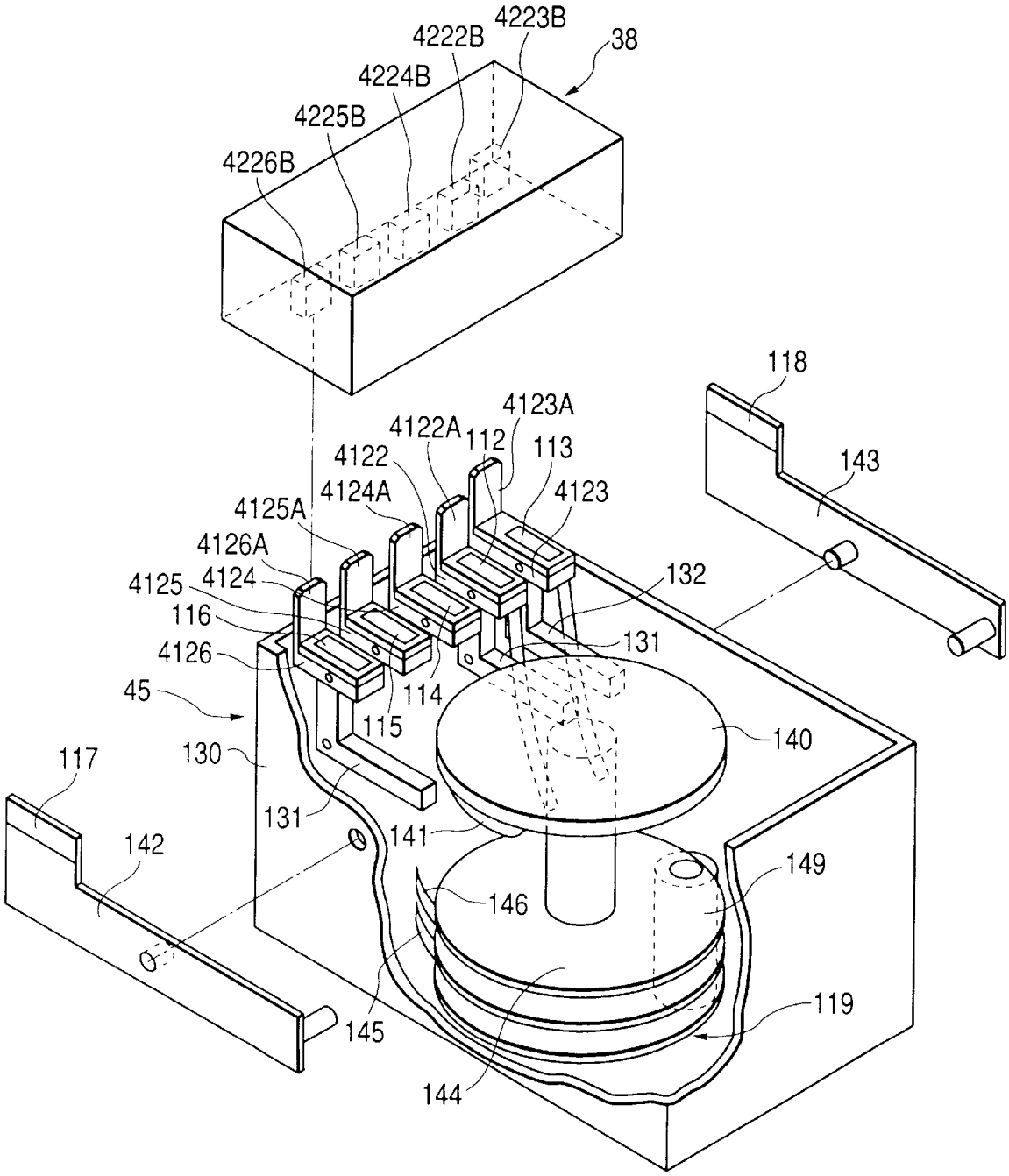
FIG. 23 is an exploded perspective view which schematically shows a recovery unit in accordance with a fourth embodiment of the present invention.
Figure 24:
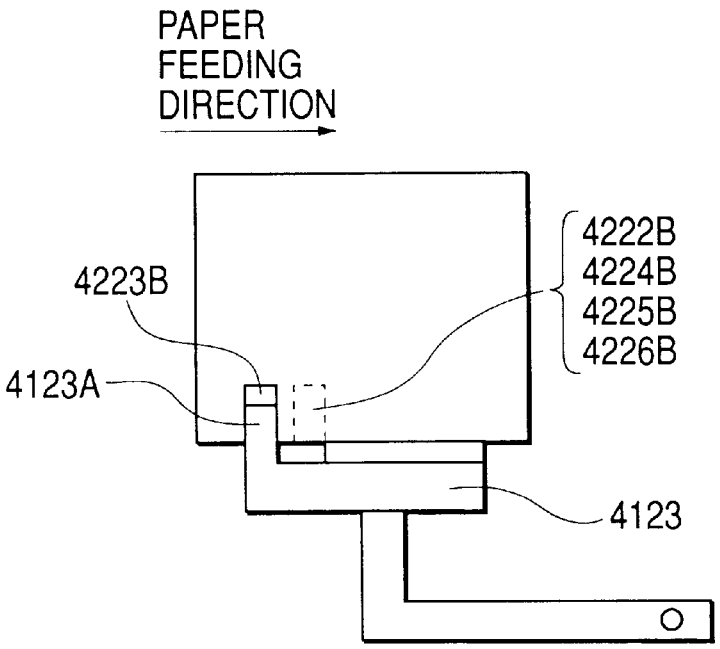
FIG. 24 is a side view which schematically shows the state where capping is left untouched in accordance with the fourth embodiment represented in FIG. 23.
Figure 25:
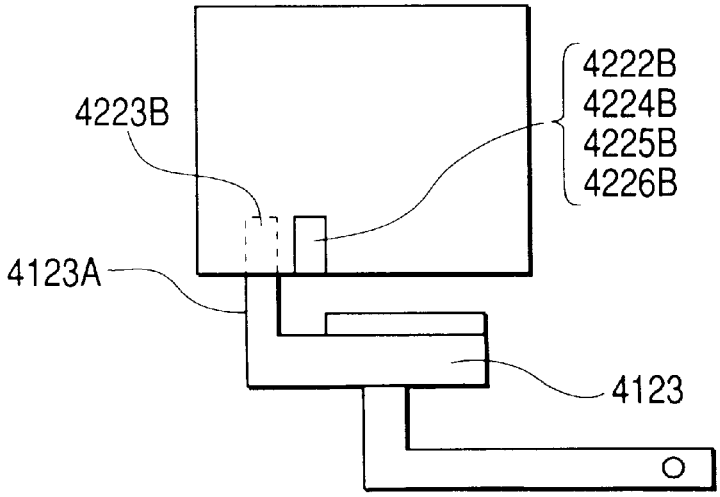
FIG. 25 is a side view which schematically shows the state of abnormal use of the recovery unit of the fourth embodiment represented in FIG. 23.

FIG. 23 is an exploded perspective view which shows a recovery unit 15 in accordance with a fourth embodiment of the present invention. FIG. 24 is a side view which schematically shows the untouched capping state of the recovery unit represented in FIG. 23. FIG. 25 is a side view which schematically shows the state of abnormal use of the recovery unit represented in FIG. 23. For the present embodiment, too, the same reference marks are applied to the same or corresponding parts as in the first, second, and third embodiments. In accordance with the present embodiment, the irregularly configured mechanism for positioning each of the caps and the recording head 38 is arranged to serve dually as the recess and extrusion provided for controlling the caps with respect to its contact with each of the discharge units.

In FIGS. 23 to 25, ribs A (4122A to 4126A) are arranged respectively for the cap holders 4122 to 4126, and at the time of capping, each of the caps is positioned to the recording head when the ribs A are allowed to fit into the recessed portions B (4223B to 4226B) formed for discharge means (discharge units) of the recording head 38.

The position of the rib A (4123A) of the processing liquid cap holder 4123 is shifted in the upstream side (or downstream side) of the positions of ribs A (4122A, 4124A, 4125A, and 4126A) of the respective color ink cap holders in the feeding direction of sheet. Also, the position of the recessed portion B (4223B) of the processing liquid discharge unit of the recording head 38 is likewise shifted in the upstream side (or downstream side) of the recessed portions B (4222B, 4224B, 4225B, and 4226B) of the respective color ink (recording ink) discharge units in the feeding direction of sheet.

Therefore, all the caps abut upon all the discharge units (recording head units) in the untouched capping state as shown in FIG. 24. However, as shown in FIG. 25, the position of the rib A (4123A) of the processing liquid cap holder 4123 does not agree with the positions of the recessed portions B (4222B, 4224B, 4225B, and 4226B) of the respective color ink discharge units in the feeding direction of sheet if the position of carriage 36 is deviated. Likewise, the positions of ribs A (4122A, 4124A, 4125A, and 4126A) of the respective color cap holders (4122, 4124, 4125, and 4126) do not agree with the position of recessed portion (4223B) of the processing liquid discharge unit of the recording head 38 in the feeding direction of sheet. As a result, the recording ink (color ink) caps are not allowed to abut upon the processing liquid discharge unit of the recording head 38. The processing liquid cap does not abut upon any one of the color ink discharge units of the recording head 38, either.

Figure 26:
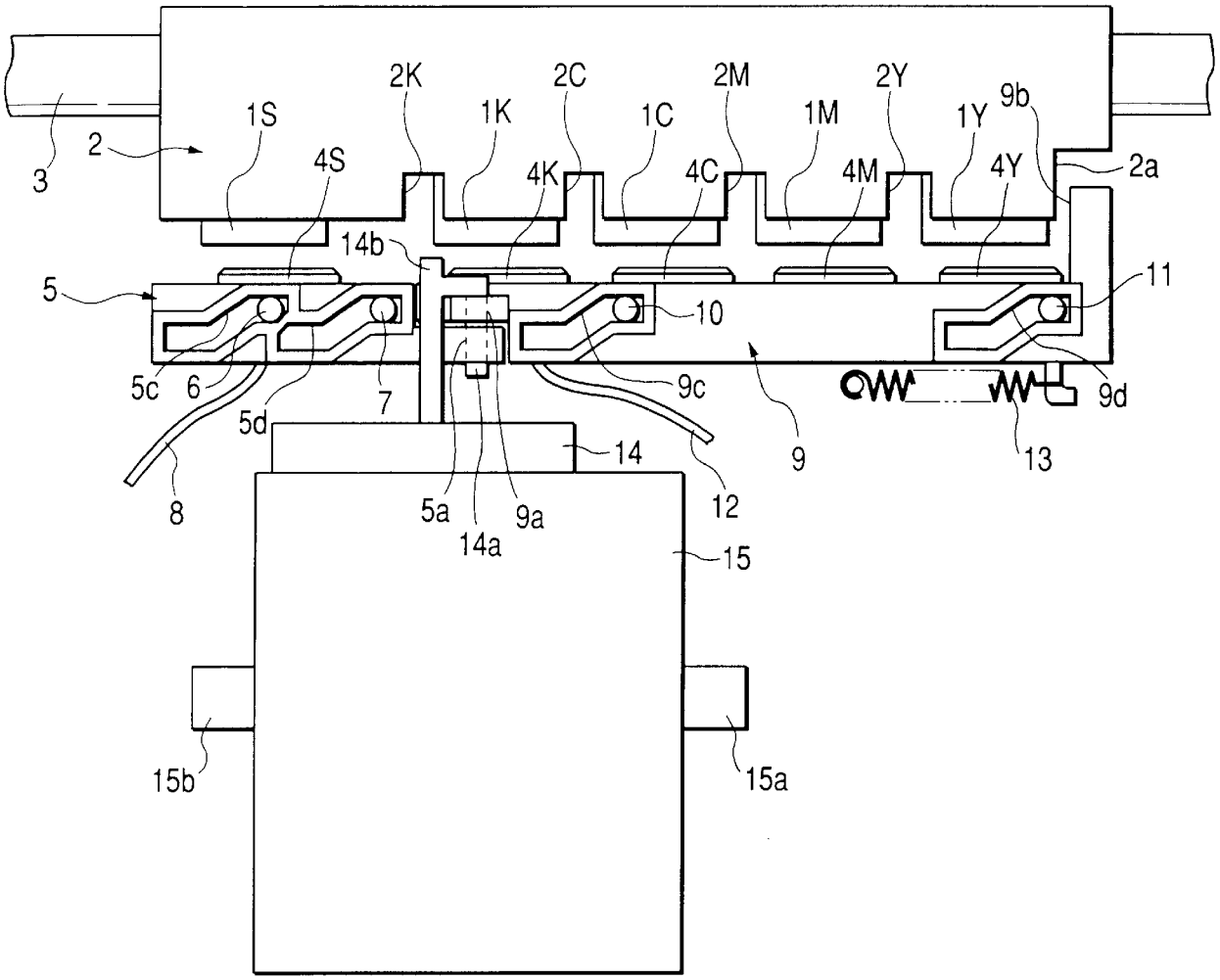
FIG. 26 is a front view which schematically shows the released state of the cap of a fifth embodiment for an ink jet recording apparatus to which the present invention is applicable.
Figure 27:
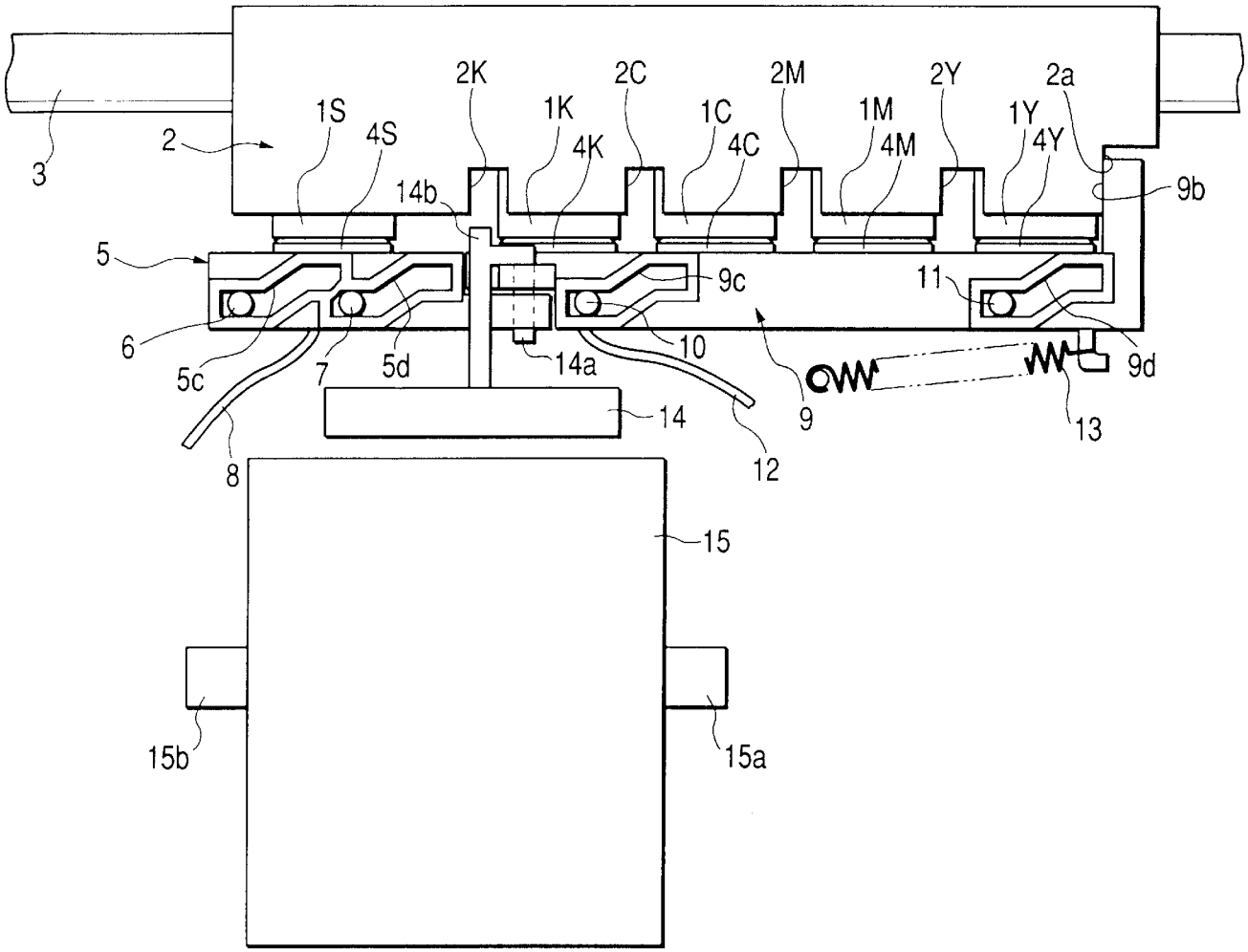
FIG. 27 is a front view which schematically shows the state where all the caps of the ink jet recording apparatus represented in FIG. 26 are capped altogether.
Figure 28:
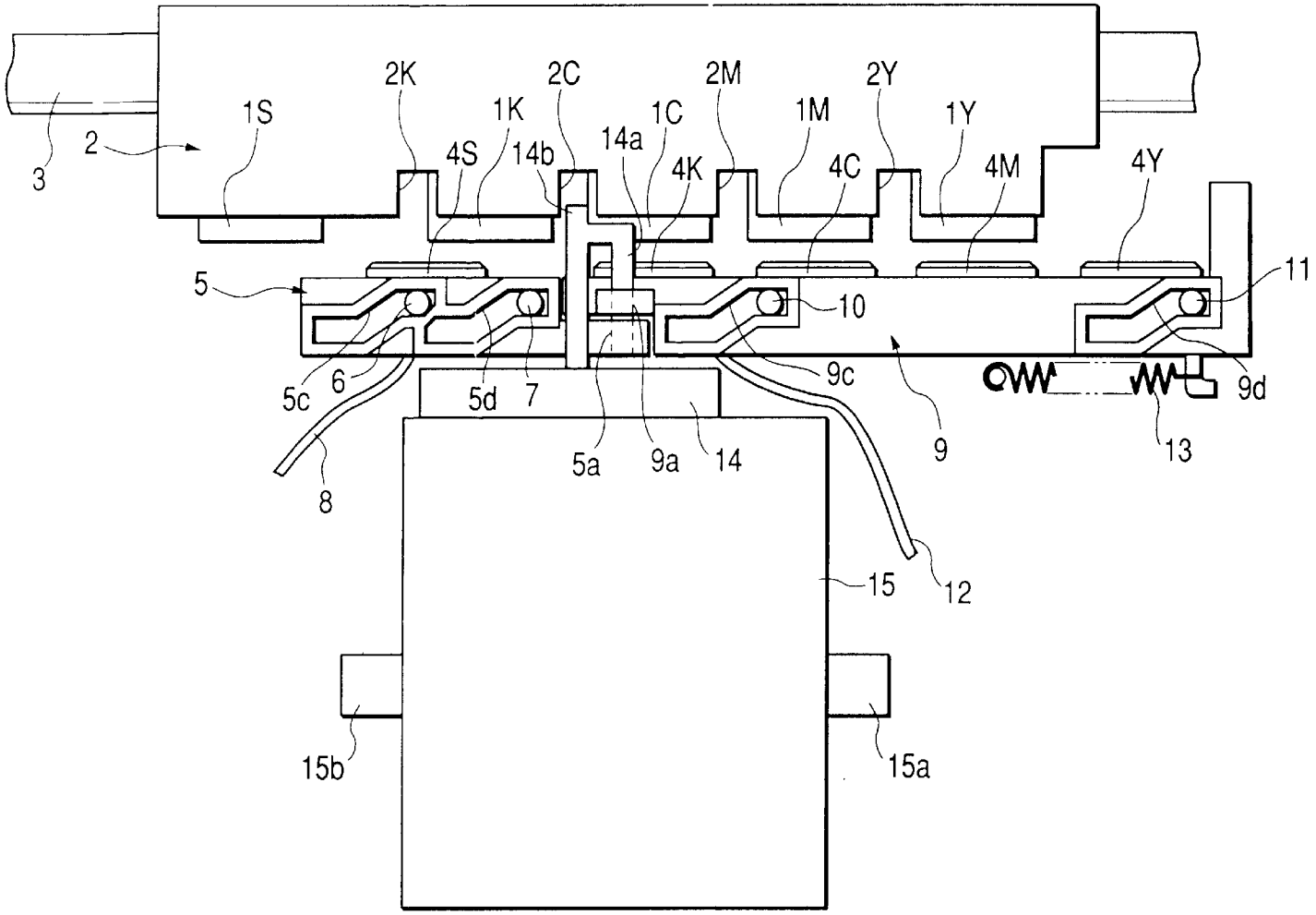
FIG. 28 is a front view which schematically shows the state before ink suction recovery begins for the ink jet recording apparatus represented in FIG. 26.
Figure 29:
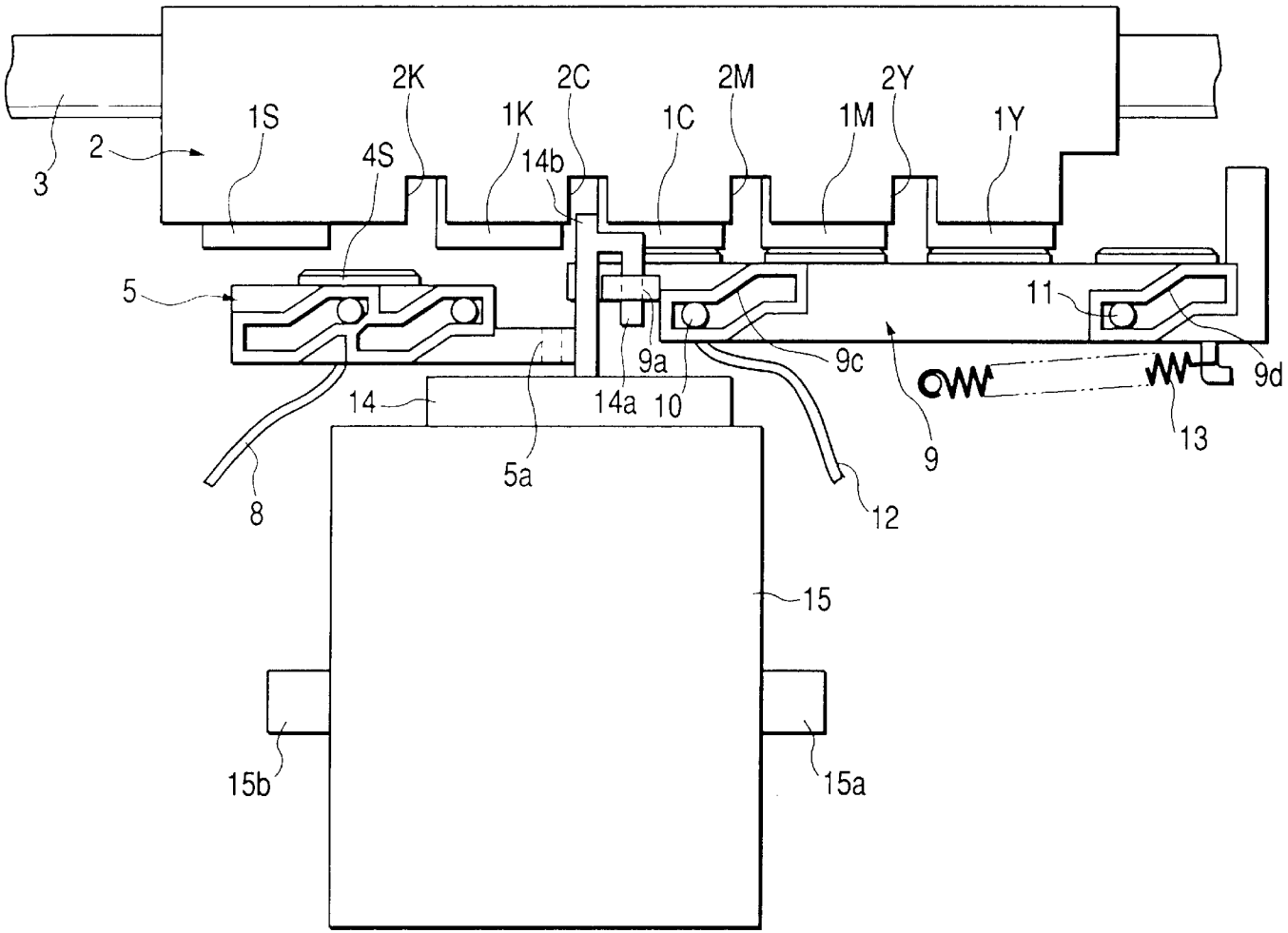
FIG. 29 is a front view which schematically shows the state at the time of ink suction recovery for the ink jet recording apparatus represented in FIG. 26.

FIG. 26 is a front view which schematically shows the released caps of an ink jet recording apparatus in accordance with a fifth embodiment of the present invention. FIG. 27 is a front view which schematically shows the state where all the caps are capped together for the ink jet recording apparatus represented in FIG. 26. FIG. 28 is a front view which schematically shows the state before ink suction recovery begins for the ink jet recording apparatus represented in FIG. 26. FIG. 29 is a front view which schematically shows the state of ink suction recovery of the ink jet recording apparatus represented in FIG. 26.

In FIGS. 26 to 29, the present embodiment shows a color ink jet recording apparatus. Discharge means 1 comprises five discharge means, namely, pre-processing liquid discharge means 1S that discharges pre-processing liquid to coagulate coloring material in each ink; black ink discharge means 1K that discharges black ink; cyan ink discharge means 1C that discharges cyan ink; magenta ink discharge means 1M that discharges magenta ink; and yellow ink discharge means 1Y that discharges yellow ink. In other words, one pre-processing liquid discharge head discharges pre-processing liquid, and four recording heads (recording means) discharge ink of different colors, respectively.

The plural discharge means described above are mounted (fixed) on a carriage 2 guided and supported so as to reciprocate on the guide rail 3 fixed on the apparatus main body (housing). Caps 4S, 4K, 4C, 4M, and 4Y are arranged correspondingly for each of the discharge means 1S, 1K, 1C, 1M, and 1Y. The cap 4S is held by the pre-processing liquid cap holder 5 which is slidably supported by pins 6 and 7 arranged on the housing (chassis) side. This cap is connected with the pre-processing suction means, which is not shown, through a tube 8.

Also, the caps 4K, 4C, 4M, and 4Y are slidably supported by pins 10 and 11 arranged on the housing (chassis) side, and held by the ink cap holder 9 in a specific position, while being biased by means of a return spring 13 in the left direction in FIGS. 26 to 29. Of these caps, the cap 4K serves dually as a suction cap at the time of ink suction. This cap is connected with ink suction means (not shown) through a tube 12. The pre-processing liquid cap holder 5 and the ink cap holder 9 can be connected by means of a connecting member 14.

The connecting member 14 is arranged so that its upper and lower positions are regulated by means of a cam 15 rotatively and axially supported on the housing side through the shafts 15*a* and 15*b*. Then, the arrangement is further made so that the shaft 14*a* can pass the through hole 5*a* of the pre-processing liquid cap holder 5 and the through hole 9*a* of the ink cap holder 9 or part from one of the holes by the vertical movement of the connecting member 14. In the state shown in FIG. 26 and FIG. 27, the shaft 14*a* is inserted through both holes 5*a* and 9*a* of the cap holders 5 and 9. Therefore, both the cap holders 5 and 9 can move (slide) together in the connected form.

The ink discharge means (recording head) 1 is ink jet recording means that utilizes thermal energy for discharging ink, which is provided with an electrothermal converting member for generating thermal energy. Also, the ink discharge means 1 utilizes pressure changes to be generated by the development and contraction of air bubbles created by film boiling brought about by the application of thermal energy exerted by the electrothermal converting member thus discharging ink from discharge ports for recording.

Figure 30:
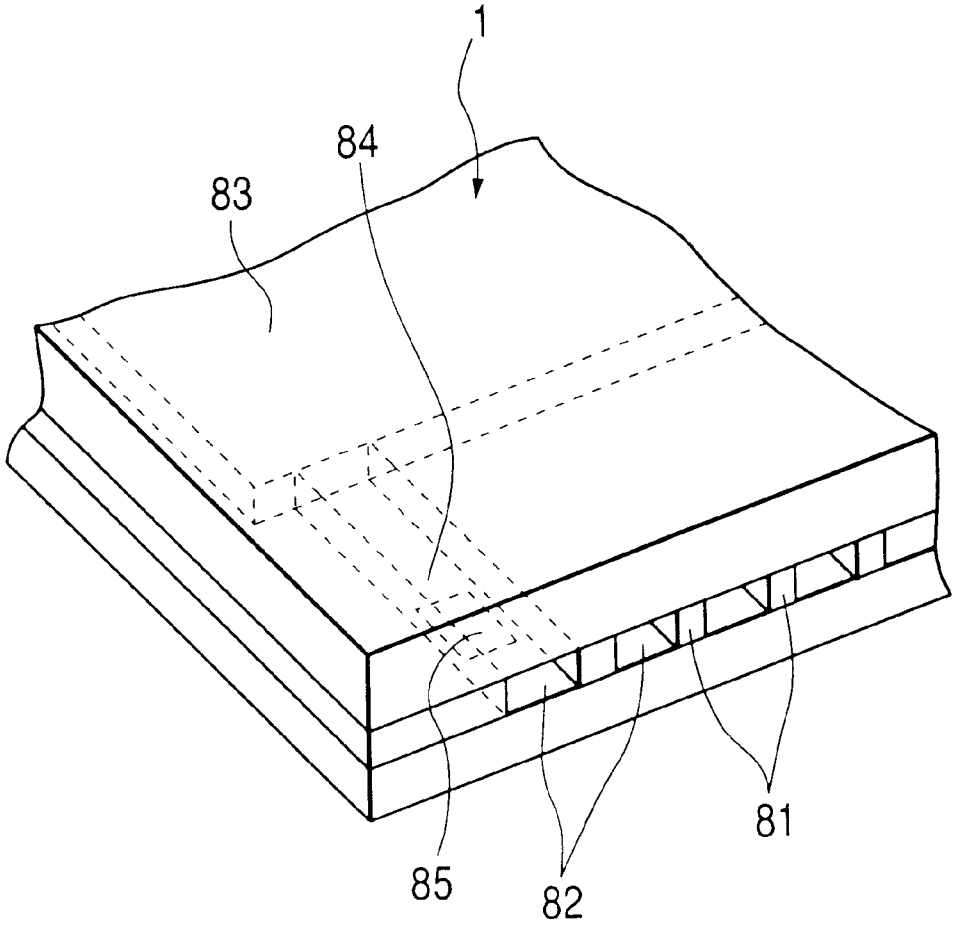
FIG. 30 is a partially perspective view which schematically shows the structure of the ink discharge unit of ink discharge means represented in FIG. 26.

FIG. 30 is a partially perspective view which schematically shows the structure of the ink discharge unit of recording means 1 described above. In FIG. 30, the discharge port formation surface 81, which faces a recording medium with a specific gap (approximately 0.5 to 2.0 mm), is provided with electrothermal converting member (heat generating resistors or the like) 85 for generating ink discharging energy, each arranged along the wall face of each of the liquid flow paths 84 conductively connected with a common liquid chamber 83 and discharge ports 82, respectively.

Recording means 1 is mounted on a carriage 2 with the positional relationship with it so that the discharge ports 82 are arranged in the direction intersecting the scanning (traveling) direction of the carriage. In this way, the corresponding electrothermal converting member are driven (energized) in response to the image signals or discharge signals. Film boiling is generated in ink in each of the liquid flow paths 84. The recording means 1 is then structured to discharge ink from the discharge ports 82 by pressure generated at that time.

Now, with reference to FIGS. 26 to 29, the description will be made of the recovery operation and the detailed structure of an ink jet recording apparatus in accordance with the fifth embodiment of the present invention. At first, the description will be made of the operation of the protection capping for the entire heads together, which is executed at the termination of recording operation or in the waiting time in the midway of recording. When the carriage 2 is caused to move in the right direction in FIGS. 26 to 29 in the released state of caps, the cut off portion 2*a* of the carriage 2 abuts upon the extrusion 9*b* of the ink cap holder 9.

When the carriage 2 is caused to move further in the right direction in FIGS. 26 to 29, each of the cap holders 5 and 9 rise gradually by being slidably guided along the recessed portions 5*c* and 5*d* and pins 6, 7 and 10, 11, each being provided with a slanted groove, respectively, while each of them moving in the right direction, and lastly as shown in FIG. 27, all the caps 4S, 4K, 4C, 4M and 4Y are closely in contact with the corresponding discharge means 1S, 1K, 1C, 1M, and 1Y, hence all the heads (discharge means) 1 being capped altogether to protect each of the discharge means (heads) 1 accordingly.

When the protection capping of each discharge means 1 should be released from the state of the collective capping shown in FIG. 27, operation is performed in the reversed order of the operational procedure described above. In other words, when the carriage 2 is caused to move in the left direction in FIG. 27, both the cap holders 5 and 9 move gradually in the left direction by the biasing force of the return spring 13, while maintaining the state of contact between the extrusion 9*b* and the cut off portion 2*a* of the carriage 2. Then, when the carriage 2 is caused to move further in the left direction, each slanted groove of the recessed portions 5*c*, 5*d* and 9*c*, 9*d* of each of the cap holders 5 and 9 moves slidably along the pins 6, 7 and 10, 11. Hence, each of the cap holders 5 and 9 descends to enable the caps 4S, 4K, 4C, 4M, and 4Y to part from discharge means (heads) 1S, 1K, 1C, 1M, and 1Y. All of the discharge means 1 are thus in the released state.

Now, the description will be made of the suction operation of pre-processing liquid. At first, by the collective capping operation described above, pre-processing liquid discharge means 1S is capped by the cap 4S as shown in FIG. 22. Then, in continuation, pre-discharge liquid suction means (a suction pump or the like), which is not shown, is driven to suck pre-processing liquid from the discharge means 1S through the tube 8. After that, by the same operation as the releasing openings for the collective capping, caps (in this case, all the caps 4S, 4K, 4C, 4M, and 4Y) are released.

Now, the description will be made of the operation of ink suction from ink discharge means. Here, with reference to FIG. 28 and FIG. 29, the suction recovery of the cyan ink discharge means (cyan recording head) 1C will be described as an example. At first, the carriage 2 is caused to move so that the cut off portion 2C for use of cyan head suction should be located immediately above the carriage contact member 14*b* of the connecting member 14. Then, the cam 15 is driven to rotate centering on the shafts 15*a* and 15*b* to raise the connecting member 14, thus obtaining the state as shown in FIG. 28. In the state shown in FIG. 28, the shaft 14*a* of the connecting member 14 is withdrawn (put out) from the hole 5*a* of the pre-processing liquid cap holder 5. Therefore, the connection between the pre-processing liquid cap holder 5 and ink cap holder 9 (physical connection between them) is released.

Then, if the carriage 2 is caused to move in the right direction from the state shown in FIG. 28, the cut off portion 2C of the carriage 2 for use of cyan head suction abuts upon the carriage contact portion 14*b* of the connecting member 14. With the further movement of the carriage 2 in the right direction, only the ink cap holder 9 moves in the right direction, while the pre-processing liquid cap holder 5 remains in that position as it is. Consequently, the slanted grooves of the recessed portions 9*c* and 9*d* of the ink cap holder 9 slide along the pins 10 and 11, which causes only the ink cap holder 9 rises gradually, while moving in the right direction, to present the state as shown in FIG. 29 at the end.

In the state shown in FIG. 29, the discharge means (cyan head 1C for the present embodiment), which should be recovery by means of suction, is capped by the cap 4K connected with ink suction means through the tube 12. In continuation, the ink suction means (a suction pump or the like), which is not shown, is driven to suck cyan ink from the cyan ink discharge means (cyan recording head) 1C through the tube 12. In this way, only the cyan ink discharge means is recovered by means of suction thus operated. At this juncture, as shown in FIG. 29, the cap 4S that corresponds to the pre-processing liquid discharge means 1S is kept in the state at a lower position where it is apart from any one of the discharge means 1. Hence, there is no possibility that this cap is in contact with any one of the ink discharge means 1K, 1C, 1M and 1Y.

In this respect, the description has been made of the case where the cyan ink discharge means 1C is recovered by means of suction as an example for the present embodiment. The suction recovery for the other ink discharge means such as black, magenta, and yellow can be executed in accordance with the similar procedures as the ink suction recovery operation described above. In accordance with the present embodiment, it is possible to keep the caps 4 and discharge means 1 in a state of being apart from each other if it is not intended to allow the caps 4 and discharge means 1 to be directly in contact at the time of suction recovery. Also, even when the pre-processing liquid is used to coagulate coloring material in ink, it is possible to prevent the pre-processing liquid from adhering to the discharge port surface of ink discharge means or entering the interior of the discharge ports at the time of executing the ink suction recovery.

Figure 31:
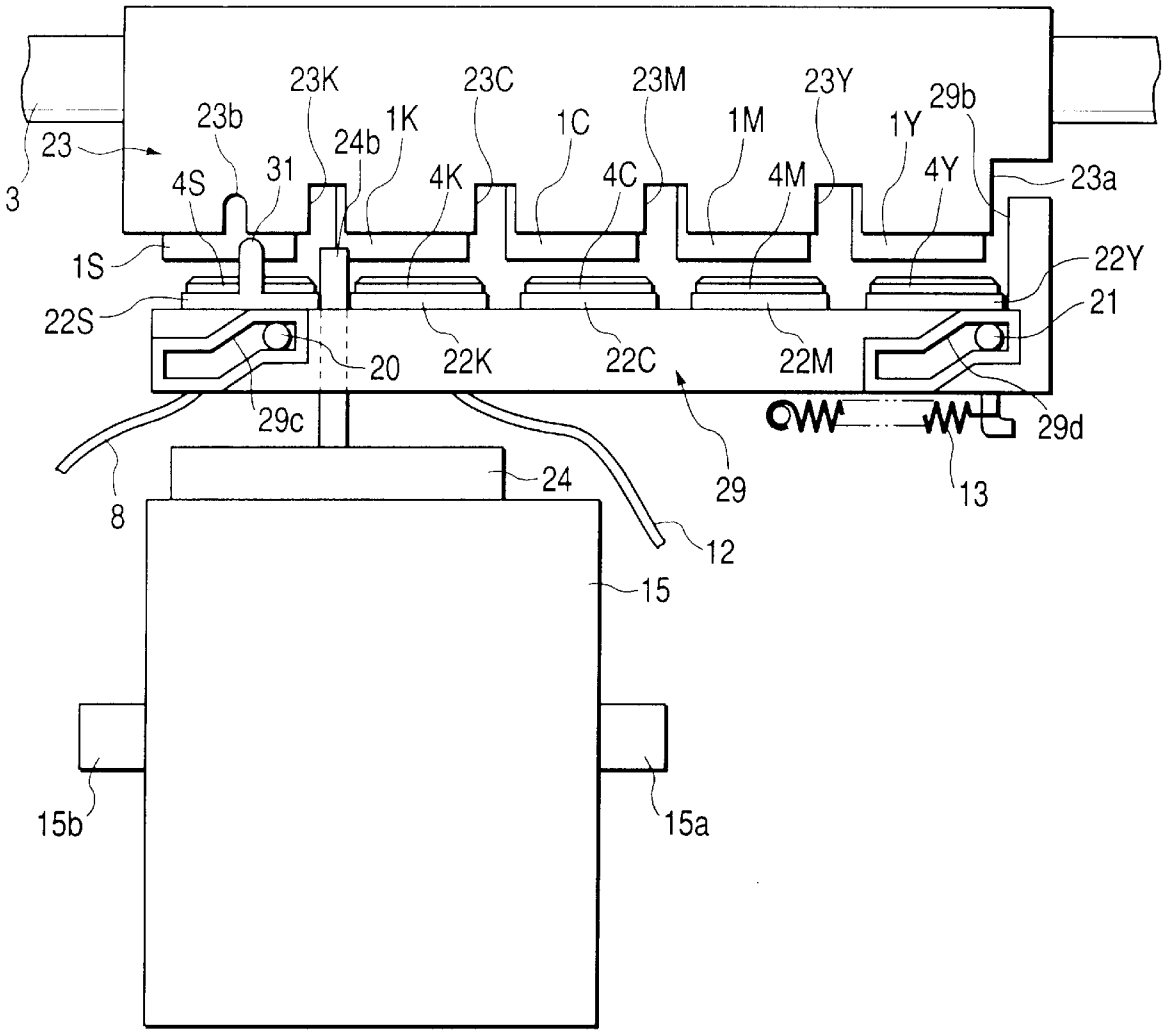
FIG. 31 is a front view which schematically shows the released state of cap of a sixth embodiment for an ink jet recording apparatus to which the present invention is applicable.
Figure 32:
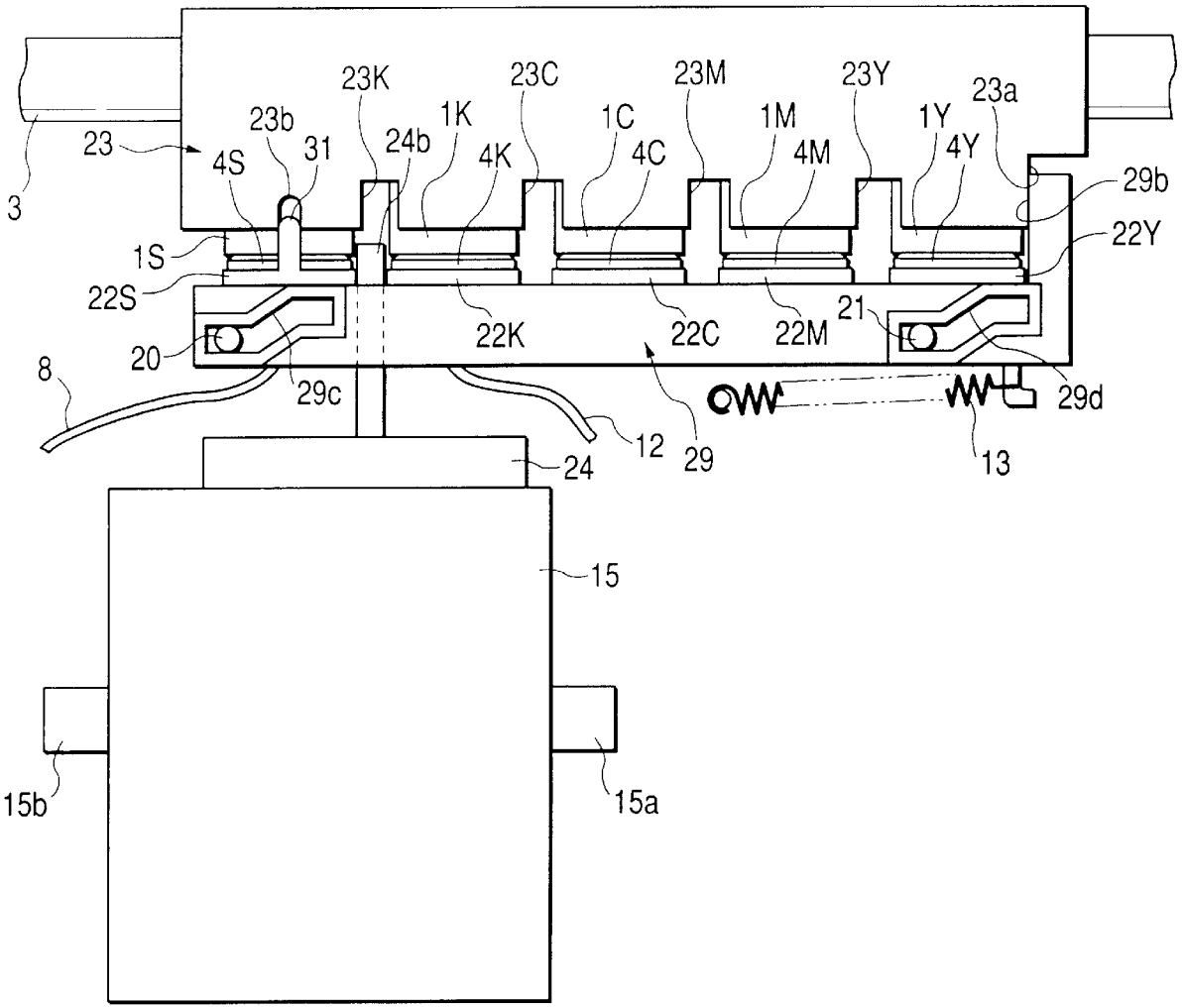
FIG. 32 is a front view which schematically shows the state at the time of capping collectively executed for the ink jet recording apparatus represented in FIG. 31.
Figure 33:
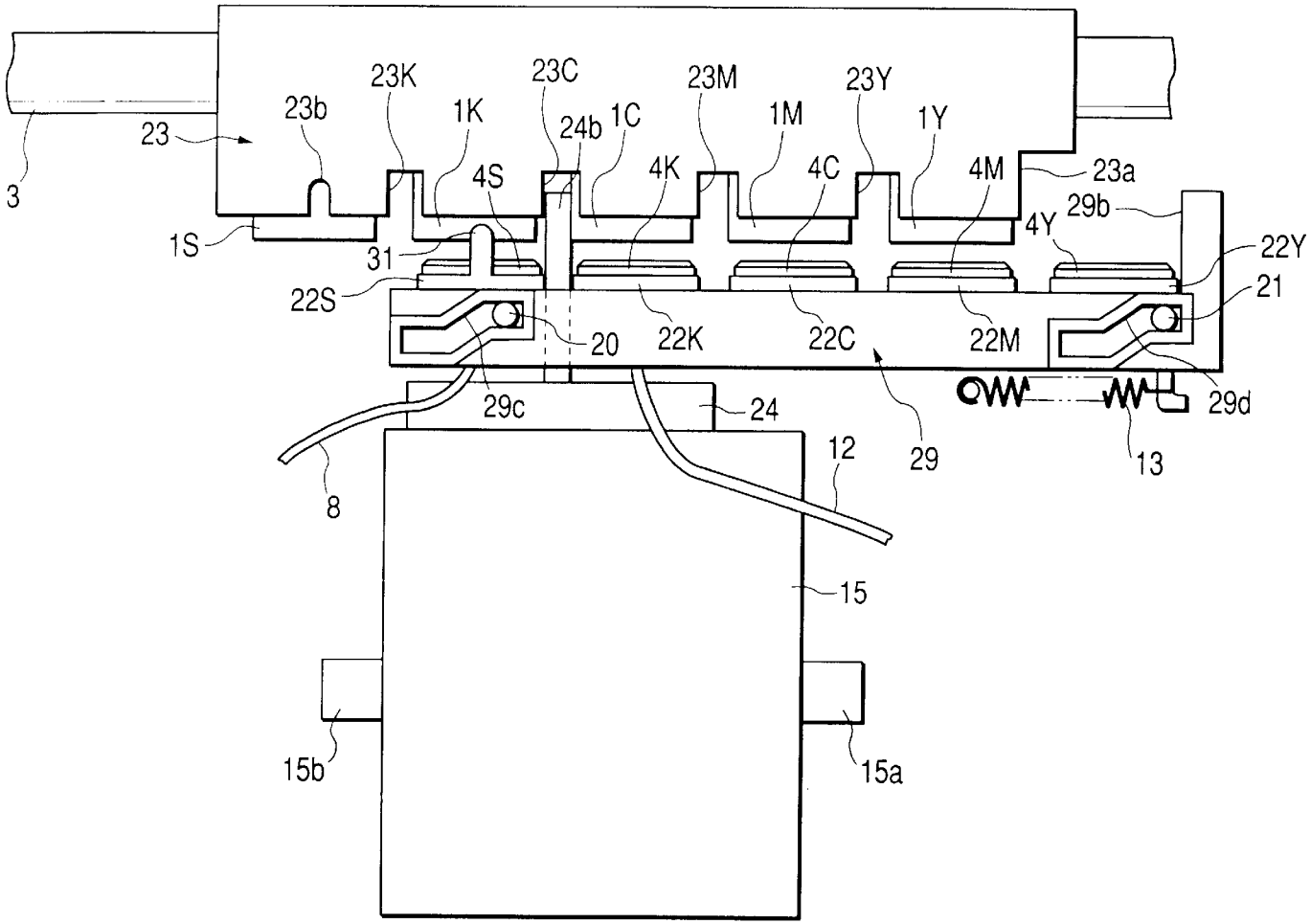
FIG. 33 is a front view which schematically shows the state before ink suction recovery begins for the ink jet recording apparatus represented in FIG. 31.
Figure 34:
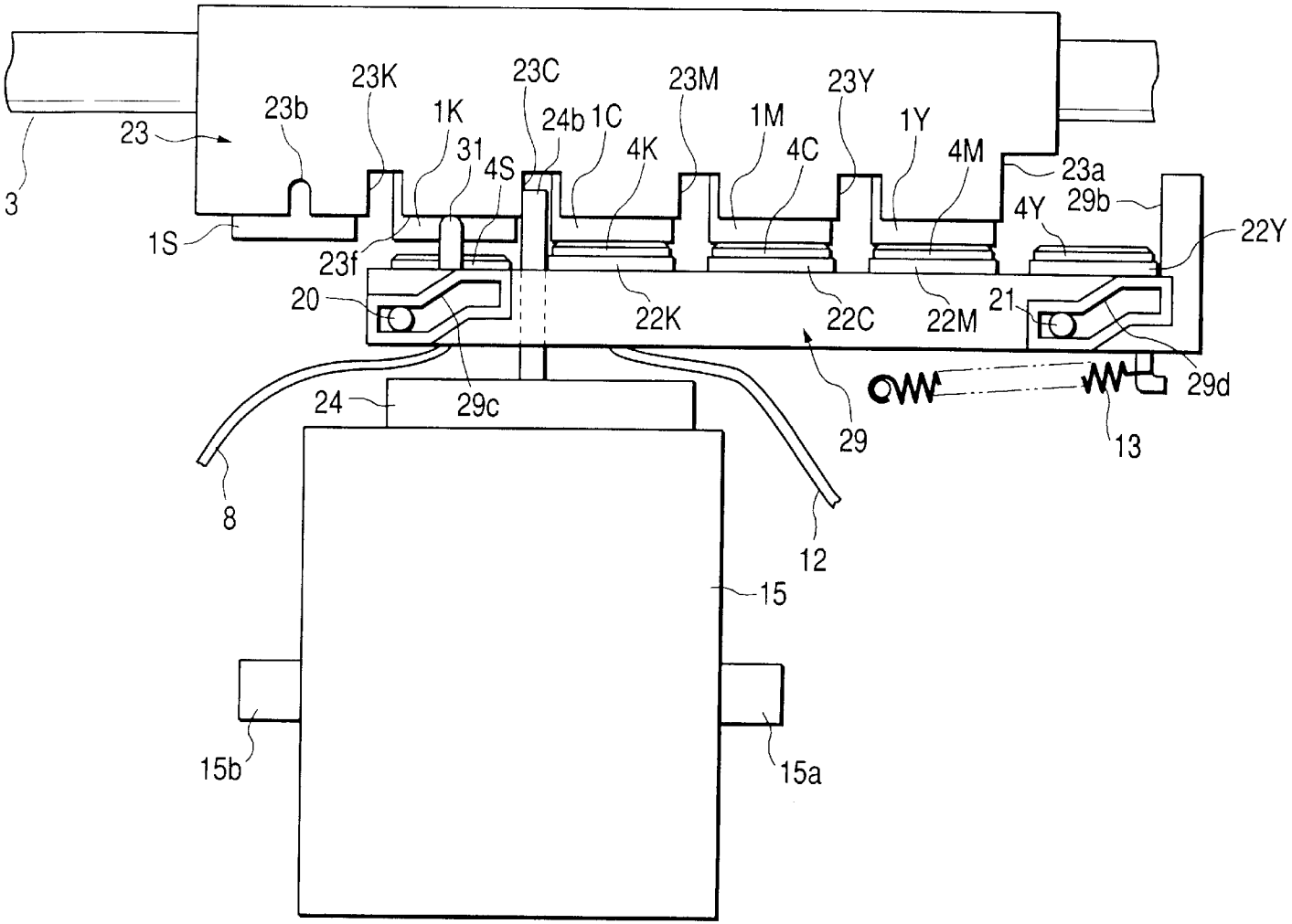
FIG. 34 is a front view which schematically shows the state at the time of ink suction recovery for the ink jet recording apparatus represented in FIG. 31.

FIG. 31 is a front view which schematically shows the released caps of an ink jet recording apparatus in accordance with a sixth embodiment of the present invention. FIG. 32 is a front view which schematically shows the state where the caps are capped collectively for the ink jet recording apparatus represented in FIG. 31. FIG. 33 is a front view which schematically shows the state before ink suction recovery begins for the ink jet recording apparatus represented in FIG. 31. FIG. 34 is a front view which schematically shows the state of ink suction recovery of the ink jet recording apparatus represented in FIG. 31.

In FIGS. 31 to 34, the present embodiment shows a color ink jet recording apparatus. Discharge means 1 comprises five discharge means in total, that is, pre-processing liquid discharge means 1S that discharges pre-processing liquid to coagulate coloring material in each ink; black ink discharge means 1K that discharges black ink; cyan ink discharge means 1C that discharges cyan ink; magenta ink discharge means 1M that discharges magenta ink; and yellow ink discharge means 1Y that discharges yellow ink.

The plural discharge means described above are mounted (fixed) on a carriage 23 guided and supported so as to reciprocate on the guide rail 3 fixed on the apparatus main body (housing). Caps 4S, 4K, 4C, 4M, and 4Y are arranged correspondingly for each of the discharge means 1S, 1K, 1C, 1M, and 1Y. These caps 4S, 4K, 4C, 4M, and 4Y are housed individually in the respective cap holders 22S, 22K, 22C, 22M, and 22Y. These cap holders 22 are arranged in a common holder unit 29. Here, each of the cap holders 22 is mounted and biased upward as shown in FIGS. 31 to 34 by means of a pressure spring (not shown) against the holder unit 29, respectively.

The holder unit 29 described above is slidably supported by means of pins 20 and 21 arranged on the housing (chassis) side, and then, biased by a return spring 13 in the left direction in FIGS. 31 to 34. Of the caps 4S, 4K, 4C, 4M, and 4Y described above, the pre-processing liquid cap 4S and one of color ink caps (for the present embodiment, the black ink cap 4K) serve dually as suction caps at the time of ink suction. These caps are connected with pre-processing liquid suction means (not shown) and ink suction means (not shown) through tubes 8 and 12, respectively.

The relative positions of the carriage 23 and holder unit 29 are regulated by means of the carriage contact 24*b* of a connecting member 24. In other words, the connecting member 24 is arranged so that its upper and lower positions are regulated by means of a cam 15 rotatively and axially supported on the housing side through the shafts 15*a* and 15*b*. Then, the structure is arranged so that the carriage contact 24*b* can be selectively in engagement with or apart from each of the cut off portions 23K, 23C, 23M and 23Y for use of head suction provided for the carriage 23. Also, in the vicinity of the pre-processing liquid discharge means of the carriage 23, a cut off portion 23*b* is formed, while an extrusion 31 that may engage with this cut off portion 23*b* is formed on the cap holder 22S of the pre-processing liquid cap 4S.

Now, with reference to FIGS. 31 to 34, the description will be made of the recovery operation and the detailed structure for an ink jet recording apparatus in accordance with the sixth embodiment of the present invention. At first, the description will be made of the operation of the protection capping for the entire heads together, which is executed at the termination of recording operation or in the waiting time in the midway of recording. When the carriage 23, having the released state of caps as shown in FIG. 31, is caused to move in the right direction in FIGS. 31 to 34, the cut off portion 23*a* of the carriage 23 abuts upon the extrusion 29*b* of the holder unit 29.

When the carriage 23 is caused to move further in the right direction in FIGS. 31 to 34, the slanted grooves of the recessed portions 29*c* and 29*d* are slidably guided along the pins 20 and 21, and the holder unit 29 rises gradually, while moving in the right direction, and lastly as shown in FIG. 32, all the caps 4S, 4K, 4C, 4M and 4Y are closely in contact with the corresponding discharge means 1S, 1K, 1C, 1M, and 1Y, hence all the heads (discharge means) 1 being capped altogether. Each of the discharge means (heads) 1 are thus protected by means of capping.

At this juncture, the extrusion 31 of the cap holder 22S that holds the pre-processing liquid cap 4S is inserted into the cut off portion 23*b* of the carriage 23. When the protection capping of each discharge means 1 should be released from the state of the collective capping shown in FIG. 31, operation is performed in the reversed order of the operational procedures described above. In other words, when the carriage 23 is caused to move in the left direction in FIG. 32, the holder unit 29 moves gradually in the left direction by means of the biasing force of the return spring 13, while keeping the contact between the extrusion 29*b* and the cut off portion 23*a* of the carriage 23 as it is. Then, when the carriage 23 is caused to move further in the left direction, each slanted groove of the recessed portions 29*c* and 29*d* of the holder unit 29 moves slidably along the pins 20 and 21. Hence, the holder unit 29 descends to enable the caps 4S, 4K, 4C, 4M, and 4Y to part from discharge means (heads) 1S, 1K, 1C, 1M, and 1Y. All of the discharge means 1 are thus in the released state.

Now, the suction operation of pre-processing liquid is executed in such a manner that the pre-processing liquid suction means (a suction pump or the like), which is not shown, is driven after the state shown in FIG. 32 has been obtained by the collective capping operation of all the heads as described above, and then, pre-processing liquid is sucked from the discharge means 1S through the tube 8. After that, the caps 4 are released by the same operation as the one performed for releasing them from the collective capping as described earlier.

Now, the description will be made of the operation of ink suction from ink discharge means. Here, with reference to FIG. 33 and FIG. 34, the suction recovery of the cyan ink discharge means (cyan recording head) will be described as an example. At first, the carriage 23 is caused to move so that the cut off portion 23C for use of cyan head suction should be located immediately above the carriage contact member 24*b* of the connecting member 24. Then, the cam 15 is driven to rotate centering on the shafts 15*a* and 15*b* to raise the connecting member 24, thus obtaining the state as shown in FIG. 33.

Then, if the carriage 23 is caused to move in the right direction from the state shown in FIG. 33, the cut off portion 23C of the carriage 23 for use of cyan head suction abuts upon the carriage contact portion 24*b* of the connecting member 24. With the further movement of the carriage 23 in the right direction, the holder unit 29 rises gradually, while moving in the right direction, when the slanted grooves of the recessed portions 29*c* and 29*d* of the holder unit slide along the pins 10 and 11, thus obtaining the state shown in FIG. 34 at the end.

In the state shown in FIG. 34, the discharge means (cyan head 1C for the present embodiment), which should be recovery by means of suction, is capped by the cap 4K connected with ink suction means through the tube 12. In continuation, the ink suction means (a suction pump or the like), which is not shown, is driven to suck cyan ink from the cyan ink discharge means (cyan recording head) 1C through the tube 12. In this way, only the cyan ink discharge means is recovered by means of suction thus operated.

At this juncture, as shown in FIG. 34, the extrusion 31 of the cap holder 22S of the cap 4S for use of pre-processing liquid is in contact with the lower surface 23*f* of the carriage 23, thus pressing down the cap holder 22S which is biased upward by the spring. As a result, the pre-processing liquid cap 4S is maintained to be apart from the discharge means (for the present embodiment, the black ink discharge head 1K that this cap faces). In other words, when ink suction (suction recovery) is performed for ink discharge means (recording heads), the pre-processing liquid cap 4S is maintained to be apart from all the discharge means 1. Hence, there is no possibility that this cap is in contact with any one of the ink discharge means 1K, 1C, 1M and 1Y.

In this respect, the description has been made of the case where the cyan ink discharge means 1C is recovered by means of suction as an example for the present embodiment. The suction recovery for the other ink discharge means such as black, magenta, and yellow can be executed in accordance with the similar procedures as the ink suction recovery operation described above. In accordance with the sixth embodiment, it is possible to keep the caps 4 and discharge means 1 in a state of being apart from each other if it is not intended to allow the caps 4 and discharge means 1 to be directly in contact at the time of suction recovery. Also, even when the pre-processing liquid is used to coagulate coloring material in ink, it is possible to prevent the pre-processing liquid from adhering to the discharge port surface of ink discharge means or entering the interior of the discharge ports at the time of executing the ink suction recovery.

Here, in accordance with the embodiments that have been described above, it becomes possible for an ink jet recording apparatus, which is provided with a main scanning driving system that enables the reciprocation of a plurality of discharge means 1 and a carriage 2 or 23 mounting the discharge means on it; a plurality of caps 4 corresponding to the discharge means 1; and the capping means that perform capping by the carriage operation, to allow only a part of entire caps to abut upon the discharge means, while keeping the remaining caps in a state of being apart from the discharge means. The structure is thus arranged to enable a selective capping, hence preventing a specific discharge means from being in contact with a specific cap when a suction recovery is executed.

Consequently, for an ink jet recording apparatus that uses the pre-processing liquid that coagulate coloring material in ink, it is possible to prevent the pre-processing liquid discharge head from being in contact with ink discharge heads when the ink suction recovery is performed. It is also possible to prevent coloring material in ink from being coagulated on the discharge port surface of the discharge means or in the interior of each cap at the time of suction recovery and the wiping operation to follow. As a result, the clogging of discharge ports, deviation of discharge directions, air leakage at the time of capping, or the like can be prevented to maintain the good quality of recorded images efficiently.

The present invention is not necessarily limited to the ink jet recording apparatus that uses the pre-processing liquid. In other words, for an ink jet recording apparatus that does not use any pre-processing liquid, the present invention is also applicable, and then, it is made possible to adopt a structure whereby to prevent caps for use of darker ink, such as black, from being in contact with the recording heads for use of lighter ink, such as yellow. In this way, it is possible to avoid any ink mixture that may take place when darker ink enters the interior of the discharge ports of recording head for use of lighter ink at the time of suction recovery and the wiping operation to follow. Hence, there is no need for the operation of idle discharges that is required for exhausting mixed ink to the outside. This arrangement contributes to the curtailment of ink consumption at the time of recovery operation, as well as the curtailment of the time required for executing the recovery operation.

In this respect, the present invention is equally applicable to the structure that uses the exchangeable head cartridge formed integrally by discharge means and discharge liquid tanks, and the structure that provides discharge means and discharge liquid tanks separately and connect them by means of liquid supply tubes or the like, among some others, irrespective of the structural arrangements of discharge means and discharge liquid tanks. The same effects are also obtainable.

Also, the present invention is applicable to an ink jet recording apparatus that uses discharge means having piezoelectric or other electromechanical transducing devices, for example. Particularly, however, the present invention may produce the most favorable effect on an ink jet recording apparatus using discharge means of the type that discharges ink by the utilization of thermal energy. With the ink jet recording apparatus, it is possible to attain recording in higher density and precision with excellence than those of the other apparatuses to which the present invention is applicable.

What is claimed is:

1. An ink jet recording apparatus comprising:

an ink cap for capping an ink discharge port to discharge an ink containing a coloring material;

a processing liquid cap for capping a processing liquid discharge port to discharge a processing liquid for processing the ink; and preventing means for preventing said ink cap from capping said processing liquid discharge port.

2. An ink jet recording apparatus according to claim 1, further comprising:

preventing means for preventing said processing liquid cap from capping said ink discharge port.

3. An ink jet recording apparatus according to claim 1, wherein the processing liquid processes insolubilization of a coloring material contained in the ink against solvent.

4. An ink jet recording apparatus according to claim 1, wherein said apparatus is provided with an electrothermal converting member for generating thermal energy to be utilized for discharging the ink from said ink discharge port.

5. An ink jet recording apparatus according to claim 1, wherein said apparatus is provided with the electrothermal converting member for generating thermal energy to be utilized for discharging the processing liquid from said processing liquid discharge port.

6. An ink jet recording apparatus comprising:

an ink cap for capping an ink discharge port to discharge an ink containing a coloring material;

a processing liquid cap for capping a processing liquid discharge port to discharge a processing liquid for processing the ink; and preventing means for preventing said processing liquid cap from capping said ink discharge port.

7. An ink jet recording apparatus according to claim 6, wherein the processing liquid processes insolubilization of the coloring material contained in the ink against solvent.

8. An ink jet recording apparatus according to claim 6, wherein said apparatus is provided with an electrothermal converting member for generating thermal energy to be utilized for discharging the ink from said ink discharge port.

9. An ink jet recording apparatus according to claim 6, wherein said apparatus is provided with electrothermal converting member for generating thermal energy to be utilized for discharging a processing liquid from said processing liquid discharge port.

10. An ink jet recording apparatus for recording by discharging an ink from ink discharge means to a recording medium, comprising:

processing liquid discharge means for discharging a processing liquid to said recording medium for insolubilizing a dye material in a recording ink against solvent, in addition to said ink discharge means; and a recovery unit for recovering the discharging capability of said ink discharge means and said processing liquid discharge means, said recovery unit being provided with capping members separately for use of said recording ink discharge means and for use of said processing liquid discharge means, a first extrusion being provided for said capping member for use of processing liquid discharge means to abut upon said recording ink discharge means for inhibiting the capping thereof, and a first recessed portion being provided for said processing liquid discharge means in a position facing said first extrusion to engage with said first extrusion.

11. An ink jet recording apparatus according to claim 10, wherein said ink discharge means is provided with a second extrusion in a position facing said first extrusion.

12. An ink jet recording apparatus for recording by discharging an ink from ink discharge means to a recording medium, comprising:

processing li quid discharge means for discharging a processing liquid to said recording medium for insolubilizing a dye material in a recording ink against solvent, in addition to said ink discharge means; and a recovery unit for recovering the discharging capability of said ink discharge means and said processing liquid discharge means, said recovery unit being provided with capping members separately for use of said recording ink discharge means and for use of said processing liquid discharge means, a first extrusion being provided for said processing liquid discharge means to abut upon the capping member for use of said recording ink discharge means for inhibiting the capping thereof, and a first recessed portion being provided for the capping member for use of said processing liquid discharge means in a position facing said first extrusion to engage with said first extrusion.

13. An ink jet recording apparatus according to claim 12, wherein the capping member for use of said ink discharge means is provided with a second extrusion in a position facing said first extrusion.

14. An ink jet recording apparatus for recording by discharging an ink from ink discharge means to a recording medium, comprising:

processing liquid discharge means for discharging a processing liquid to said recording medium for insolubilizing a dye material in a recording ink against solvent, in addition to said ink discharge means; and a recovery unit for recovering the discharging capability of said ink discharge means and said processing liquid discharge means, said recovery unit being provided with capping members separately for use of said recording ink discharge means and for use of said processing liquid discharge means, a first extrusion being provided for said processing liquid discharge means to abut upon the capping member for use of said recording ink discharge means for inhibiting the capping thereof, at the same time, a first recessed portion being provided for the capping member for use of said processing liquid discharge means in a position facing said first extrusion to engage with said first extrusion, and a second extrusion being provided for the capping member for use of said ink discharge means to abut upon said processing liquid discharge means for inhibiting the capping thereof, at the same time, a second recessed portion being provided for recording ink discharge means in a position facing said second extrusion to engage with said second extrusion.

15. An ink jet recording apparatus for recording by discharging an ink from ink discharge means to a recording medium, comprising:

processing liquid discharge means for discharging a processing liquid to said recording medium for insolubilizing a dye material in a recording ink against solvent, in addition to said ink discharge means; and a recovery unit for recovering the discharging capability of said ink discharge means and said processing liquid discharge means, said recovery unit being provided with capping members separately for use of said recording ink discharge means and for use of said processing liquid discharge means, a first extrusion being provided for said ink discharge means to abut upon the capping member for use of said processing liquid discharge means for inhibiting the capping thereof, at the same time, a first recessed portion being provided for the capping member for use of said ink discharge means in a position facing said first extrusion to engage with said first extrusion, and a second extrusion being provided for the capping member for use of said processing liquid discharge means to abut upon said ink discharge means for inhibiting the capping thereof, at the same time, a second recessed portion being provided for processing liquid discharge means in a position facing said second extrusion to engage with said second extrusion.

16. An ink jet recording apparatus according to any one of claims 10–15, wherein the positioning of processing liquid discharge means and recording ink discharge means is executed by means of the engagement between said extrusion and said recessed portion.

17. An ink jet recording apparatus according to claim 16, wherein the positioning of the capping member for use of processing liquid discharge means is executed in a shifted position on the upstream side or downstream side of the positioning location of the capping member for use of recording ink discharge means in the feeding direction of a recording medium.

18. An ink jet recording apparatus according to any one of claims 10–15, wherein said apparatus is provided with electrothermal converting member for generating thermal energy to be utilized for discharging the ink from said ink discharge port.

19. An ink jet recording apparatus for recording by discharging an ink from discharge means to a recording medium, comprising:

a plurality of discharge means;

a main scanning driving system for enabling the reciprocation of a carriage having discharge means mounted thereon;

a plurality of caps for discharge means; and capping means for operating capping by means of a carriage movement, and a selective capping operation being made executable so as to cause some of all said caps to abut upon discharge means, while the remaining caps being maintained in a state of being apart therefrom.

20. An ink jet recording apparatus according to claim 19, wherein a selective capping operation is made executable so as to perform a collective capping for all the plural caps to enable them to abut upon all the discharge means entirely or to cause a part of the caps to abut upon discharge means, while the remaining caps being maintained in a state of being apart therefrom.

21. An ink jet recording apparatus according to claim 19 or claim 20, wherein at least one of the plural caps is connected with suction means for sucking liquid from discharge means.

22. An ink jet recording apparatus according to claim 19, wherein said apparatus is provided with ink discharge means for discharging an ink containing a coloring material, pre-processing liquid discharge means for discharging said pre-processing liquid, ink suction means in a number smaller than the number said ink discharge means, and pre-processing liquid suction means, and the cap connected with said pre-processing liquid suction means is maintained in a state of being apart from said discharge means at the time of operating ink suction.

23. An ink jet recording apparatus according to claim 19, wherein said recording means is provided with electrothermal converting member for generating thermal energy to be utilized for discharging the ink.

24. An ink jet recording apparatus according to claim 23, wherein said recording means utilizes film boiling created in the ink by the application of thermal energy generated by said electrothermal converting member for discharging the ink from discharge ports.

* * * * *

UNITED STATES PATENT AND TRADEMARK OFFICE

CERTIFICATE OF CORRECTION

PATENT NO. : 5,992,966
DATED : November 30, 1999
INVENTOR(S) : Tetsuhiro Nitta el al.

It is certified that error appears in the above-identified patent and that said Letters Patent is hereby corrected as shown below:

Title page:
Under U.S. Patent Documents, "5,563,538" should read -- 5,563,638 --.
Under Foreign Patent Documents, "1152739" should read -- 1-152739 --.

Column 1:
Line 10, "functions as" should read -- functions of --;
Line 13, "equipment" should read -- arrangement --;
Line 17, "plate" should read -- plate or the like --;
Line 32, "hand, a" should read -- hand, with a --;
Line 46, "can-operate" should read -- can operate --; and
Line 58, "with the a" should read -- with a --.

Column 2:
Llines 63 and 65, "whereby" should read -- thereby --.

Column 3:
Line 44, "fixed to" should read -- fixed so as to --.

Column 4:
Line 26, "directions," should read -- directions; --.

Column 5:
Line 9, "being" should read -- are --.

Column 6:
Lines 22 and 31, "objectives" should read -- objective --; and
Line 39, "invention to" should read -- invention include: to --.

Column 8:
Line 11, "being" should read -- are --.

UNITED STATES PATENT AND TRADEMARK OFFICE

CERTIFICATE OF CORRECTION

PATENT NO. : 5,992,966
DATED : November 30, 1999
INVENTOR(S) : Tetsuhiro Nitta el al.

It is certified that error appears in the above-identified patent and that said Letters Patent is hereby corrected as shown below:

Column 10:
Line 62, "supply" should read -- supplied --.

Column 12:
Line 65, "and nd any" should read -- and any --.

Column 16:
Line 53, "member" should read -- members --

Column 17:
Line 5, "rise" should read rises;
Line 8, "moving" should read -- moves --; and
Line 11, "being" should read -- are --.

Column 18:
Line 1, "rises" should read -- to rise --.

Column 19:
Line 43, "being" should read -- are --.

Column 21:
Line 17, "coagulate" should read -- coagulates --; and
Line 53, "connect" should read -- connects --.

Column 22:
Line 45, "electrothermal" should read -- an electrothermal --.

Column 23:
Line 10, "li quid" should read -- liquid --.

UNITED STATES PATENT AND TRADEMARK OFFICE

CERTIFICATE OF CORRECTION

PATENT NO. : 5,992,966
DATED : November 30, 1999
INVENTOR(S) : Tetsuhiro Nitta et al.

It is certified that error appears in the above-identified patent and that said Letters Patent is hereby corrected as shown below:

Column 24:
Line 39, "electrothermal" should read -- an electrothermal --; and
Lines 55 and 62, "being" should read -- are --.

Column 25:
Line 6, "number said" should read -- number of said --.

Signed and Sealed this

Ninth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,992,966
DATED : November 30, 1999
INVENTOR(S) : Tetsuhiro Nitta et al.

It is certified that error appears in the above-identified patent and that said Letters Patent is hereby corrected as shown below:

Title page,
U.S. PATENT DOCUMENTS, "5,563,538" should read -- 5,563,638 --.

FOREIGN PATENT DOCUMENTS, "1152739" should read -- 1-152739 --.

Column 1,
Line 10, "functions as" should read -- functions of --;
Line 13, "equipment" should read -- arrangement --;
Line 17, "plate" should read -- plate or the like --;
Line 32, "hand, a" should read -- hand, with a --;
Line 46, "can-operate" should read -- can operate --; and
Line 58, "with the a" should read -- with a --.

Column 2,
Lines 63 and 65, "whereby" should read -- thereby --.

Column 3,
Line 44, "fixed to" should read -- fixed so as to --.

Column 4,
Line 26, "directions," should read -- directions; --.

Column 5,
Line 9, "being" should read -- are --.

Column 6,
Lines 22 and 31, "objectives" should read -- objective --; and
Line 39, "invention to" should read -- invention include: to --.

Column 8,
Line 11, "being" should read -- are --.

Column 10,
Line 62, "supply" should read -- supplied --.

Column 12,
Line 65, "and nd any" should read -- and any -- .

Column 16,
Line 53, "member" should read -- members --.

UNITED STATES PATENT AND TRADEMARK OFFICE

CERTIFICATE OF CORRECTION

PATENT NO. : 5,992,966
DATED : November 30, 1999
INVENTOR(S) : Tetsuhiro Nitta et al.

It is certified that error appears in the above-identified patent and that said Letters Patent is hereby corrected as shown below:

Column 17,
Line 5, "rise" should read -- rises --;
Line 8, "moving" should read -- moves --; and
Line 11, "being" should read -- are --.

Column 18,
Line 1, "rises" should read -- to rise --.

Column 19,
Line 43, "being" should read -- are --.

Column 21,
Line 17, "coagulate" should read -- coagulates --; and
Line 53, "connect" should read -- connects --.

Column 22,
Line 45, "electrothermal" should read -- an electrothermal --.

Column 23,
Line 10, "li quid" should read -- liquid --.

Column 24,
Line 39, "electrothermal" should read -- an electrothermal --; and
Line 55 and 62, "being" should read -- are --.

Column 25,
Line 6, "number said" should read -- number of said --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*